US010123134B2

(12) United States Patent
Jensen et al.

(10) Patent No.: US 10,123,134 B2
(45) **Date of Patent: *Nov. 6, 2018**

(54) BINAURAL HEARING ASSISTANCE SYSTEM COMPRISING BINAURAL NOISE REDUCTION

(71) Applicant: Oticon A/S, Smørum (DK)

(72) Inventors: Jesper Jensen, Smørum (DK); Michael Syskind Pedersen, Smørum (DK); Jan Mark De Haan, Smørum (DK)

(73) Assignee: Oticon A/S, Smørum (DK)

( * ) Notice: Subject to any disclaimer, the term of this patent is extended or adjusted under 35 U.S.C. 154(b) by 52 days.

This patent is subject to a terminal disclaimer.

(21) Appl. No.: 15/340,369

(22) Filed: Nov. 1, 2016

(65) Prior Publication Data

US 2017/0048626 A1 Feb. 16, 2017

Related U.S. Application Data

(62) Division of application No. 14/677,261, filed on Apr. 2, 2015, now Pat. No. 9,516,430.

(30) Foreign Application Priority Data

Apr. 3, 2014 (EP) ..... 14163333

(51) Int. Cl.
*H04R 25/00* (2006.01)
*G10L 25/78* (2013.01)

(52) U.S. Cl.
CPC ..... *H04R 25/552* (2013.01); *H04R 25/405* (2013.01); *H04R 25/407* (2013.01); (Continued)

(58) Field of Classification Search
CPC .... H04R 25/40; H04R 25/402; H04R 25/405; H04R 25/407; H04R 25/43; H04R 25/50; (Continued)

(56) References Cited

U.S. PATENT DOCUMENTS 5,511,128 A 4/1996 Lindemann
5,757,932 A 5/1998 Lindemann et al.
(Continued)

FOREIGN PATENT DOCUMENTS

EP 2 200 342 A1 6/2010
EP 2 506 603 A2 10/2012
(Continued)

OTHER PUBLICATIONS

Graham, "Voice recognition software reads your brainwaves," New Scientist, Nov. 13, 2008, XP055203033, pp. 1-4, URL: https://www.newscientist.com/article/dn16034-voice-recognition-software-reads-your-brain-waves/.

*Primary Examiner* — Joshua Kaufman
(74) *Attorney, Agent, or Firm* — Birch, Stewart, Kolasch & Birch, LLP

(57) ABSTRACT

A binaural hearing assistance method and system comprising left and right hearing assistance devices and a user interface are provided. The left and right hearing assistance devices comprises a) at least two input units for providing a time-frequency representation of an input signal in a number of frequency bands and a number of time instances; and b) a multi-input unit noise reduction system comprising a multi-channel beamformer filtering unit operationally coupled to said at least two input units and configured to provide a beamformed signal. The binaural hearing assistance system is configured to allow a user to indicate a direction to or location of a target signal source relative to the user via said user interface.

25 Claims, 9 Drawing Sheets

(52) U.S. Cl.
CPC ..... *H04R 25/558* (2013.01); *G10L 25/78* (2013.01); *H04R 25/554* (2013.01); *H04R 2225/43* (2013.01); *H04R 2225/61* (2013.01); *H04R 2430/20* (2013.01)

(58) Field of Classification Search
CPC .... H04R 25/502; H04R 25/505; H04R 25/55; H04R 25/552; H04R 25/554; H04R 25/558; H04R 2225/43; H04R 2225/53; H04R 2225/55; H04R 2430/20; H04R 2430/21; H04R 2430/23; H04R 2430/25
See application file for complete search history.

(56) References Cited

U.S. PATENT DOCUMENTS

| | | | |
|---|---|---|---|
| 7,076,072 | B2 | 7/2006 | Feng et al. |
| 7,206,423 | B1 | 4/2007 | Feng et al. |
| 2003/0138116 | A1 | 7/2003 | Jones et al. |
| 2004/0202339 | A1 | 10/2004 | O'Brien, Jr. et al. |
| 2008/0260189 | A1 | 10/2008 | Schobben |
| 2009/0202091 | A1 | 8/2009 | Pedersen et al. |
| 2010/0160714 | A1 | 6/2010 | Chua et al. |
| 2010/0183158 | A1 | 7/2010 | Haykin et al. |
| 2011/0305345 | A1 | 12/2011 | Bouchard et al. |
| 2012/0008807 | A1* | 1/2012 | Gran ..... H04R 25/407 381/313 |
| 2012/0250916 | A1 | 10/2012 | Hain et al. |
| 2013/0051565 | A1 | 2/2013 | Pontoppidan |
| 2013/0051566 | A1 | 2/2013 | Pontoppidan |
| 2013/0170653 | A1 | 7/2013 | Gran et al. |
| 2013/0170680 | A1 | 7/2013 | Gran et al. |
| 2013/0208896 | A1 | 8/2013 | Chatlani et al. |
| 2013/0329923 | A1 | 12/2013 | Bouse |
| 2014/0010373 | A1 | 1/2014 | Gran et al. |
| 2014/0016788 | A1 | 1/2014 | Rass |
| 2014/0056435 | A1 | 2/2014 | Kjems et al. |
| 2014/0185847 | A1 | 7/2014 | Gran et al. |
| 2014/0198936 | A1 | 7/2014 | Higgins et al. |
| 2014/0348331 | A1 | 11/2014 | Gran et al. |
| 2014/0369537 | A1 | 12/2014 | Pontoppidan et al. |
| 2015/0049892 | A1 | 2/2015 | Petersen et al. |
| 2015/0156592 | A1 | 6/2015 | Jensen |
| 2015/0163602 | A1 | 6/2015 | Pedersen et al. |
| 2015/0181355 | A1 | 6/2015 | Pedersen |
| 2015/0230026 | A1 | 8/2015 | Eichfeld et al. |
| 2015/0230036 | A1 | 8/2015 | Pedersen et al. |
| 2015/0289064 | A1 | 10/2015 | Jensen et al. |
| 2015/0289065 | A1 | 10/2015 | Jensen et al. |
| 2015/0373464 | A1 | 12/2015 | Dittberner |

FOREIGN PATENT DOCUMENTS

| | | | |
|---|---|---|---|
| EP | 2 701 145 | A1 | 2/2014 |
| WO | WO 2007/052185 | A2 | 5/2007 |

* cited by examiner

BINAURAL HEARING ASSISTANCE SYSTEM COMPRISING BINAURAL NOISE REDUCTION

CROSS-REFERENCE OF RELATED APPLICATIONS

This application is a Divisional of co-pending application Ser. No. 14/677,261, filed on Apr. 2, 2015, which claims priority under 35 U.S.C. § 119(a) to European Application No. 14163333.9, filed on Apr. 3, 2014, all of which are hereby expressly incorporated by reference into the present application.

TECHNICAL FIELD

The present application relates to hearing assistance devices, in particular to noise reduction in binaural hearing assistance systems. The disclosure relates specifically to a binaural hearing assistance system comprising left and right hearing assistance devices, and a user interface configured to communicate with said left and right hearing assistance devices and to allow a user to influence functionality of the left and right hearing assistance devices.

The application furthermore relates to use of a binaural hearing assistance system and to a method of operating a binaural hearing assistance system.

Embodiments of the disclosure may e.g. be useful in applications such as audio processing systems where the maintenance or creation of spatial cues are important, such as in a binaural system where a hearing assistance device is located at each ear of a user. The disclosure may e.g. be useful in applications such as hearing aids, headsets, ear phones, active ear protection systems, etc.

BACKGROUND

The following account of the prior art relates to one of the areas of application of the present application, hearing aids.

Traditionally, 'spatial' or 'directional' noise reduction systems in hearing aids operate using the underlying assumption that the sound source of interest (the target) is located straight ahead of the hearing aid user. A beamforming system is then used which aims at enhancing the signal source from the front while suppressing signals from any other direction.

In several typical acoustic situations, the assumption of the target being in front is far from valid, e.g., car cabin situations, dinner parties where a conversation is conducted with the person sitting next to you, etc. So: in many noisy situations, the need arises for being able to "listen to the side" while still suppressing the ambient noise.

EP2701145A1 deals with improving signal quality of a target speech signal in a noisy environment, in particular to estimation of the spectral inter-microphone correlation matrix of noise embedded in a multichannel audio signal obtained from multiple microphones present in an acoustical environment comprising one or more target sound sources and a number of undesired noise sources.

SUMMARY

The present disclosure proposes to use a user-controlled and binaurally synchronized Multi-Channel Enhancement systems, one in/at each ear, to provide an improved noise reduction system in a binaural hearing assistance system. The idea is to let the hearing aid user "tell" the hearing assistance system (encompassing the hearing assistance devices located on or in each ear), the location of the target sound source (e.g. direction and potentially distance to), either relative to the nose of the user or in absolute coordinates. There are many ways in which the user can provide this information to the system. In a preferred embodiment, the system is configured to use an auxiliary device, e.g. in the form of a portable electronic device (e.g. a remote control or a cellular phone, e.g. a SmartPhone) with a touch-screen, and let the user indicate listening direction and potentially distance via such device. Alternatives to provide this user-input include activation elements (e.g. program buttons) on hearing assistance devices (where e.g. different programs "listen" in different directions), pointing devices of any sort (pens, phones, pointers, streamers, etc.) communicating wirelessly with the hearing assistance devices, head tilt/movement picked up by gyroscopes/accelerometers in the hearing assistance devices, or even brain-interfaces e.g., realized using EEG electrodes (e.g. in or on the hearing assistance devices).

According to the present disclosure, each hearing assistance devices comprises a multi-microphone noise reduction system, which are synchronized, so that they focus on the same point or area in space (the location of the target source). In an embodiment, the information communicated and shared between the two hearing assistance devices includes a direction and/or distance (or range) to a target signal source. In an embodiment of the proposed system, information from respective voice activity detectors (VAD), and gain values applied by respective single-channel noise reduction systems, are shared (exchanged) between the two hearing assistance devices for improved performance.

In an embodiment, the binaural hearing assistance system comprises at least two microphones.

Another aspect of the beamformer/single-channel noise reduction system of the respective hearing assistance devices is that they are designed in such a way that interaural cues of the target signals are maintained, even in noisy situations. Hence, the target source presented to the user sounds as if originating from the correct direction, while the ambient noise is reduced.

An object of the present application is to provide an improved binaural hearing assistance system. It is a further object of embodiments of the disclosure to improve signal processing (e.g. aiming at improved speech intelligibility) in a binaural hearing assistance system, in particular in acoustic situations, where the (typical) assumption of the target signal source being located in front of the user is not valid. It is a further object of embodiments of the disclosure to simplify processing of a multi-microphone beamformer unit.

Objects of the application are achieved by the invention described in the accompanying claims and as described in the following.

A Binaural Hearing Assistance System:

In an aspect of the present application, an object of the application is achieved by a binaural hearing assistance system comprising left and right hearing assistance devices adapted for being located at or in left and right ears of a user, or adapted for being fully or partially implanted in the head of the user, the binaural hearing assistance system further comprising a user interface configured to communicate with said left and right hearing assistance devices and to allow a user to influence functionality of the left and right hearing assistance devices, each of the left and right hearing assistance devices comprising a) a multitude of input units IUi, i=1, . . . , M, M being larger than or equal to two, for providing a time-frequency representation Xi(k,m) of an input signal xi(n) at an ith input unit in a number of frequency bands and a number of time instances, k being a frequency band index, m being a time index, n representing time, the time-frequency representation Xi(k,m) of the ith input signal comprising a target signal component and a noise signal component, the target signal component originating from a target signal source;

b) a multi-input unit noise reduction system comprising a multi-channel beamformer filtering unit operationally coupled to said multitude of input units IUi, i=1, . . . , M, and configured to provide a beamformed signal Y(k,m), wherein signal components from other directions than a direction of a target signal source are attenuated, whereas signal components from the direction of the target signal source are left un-attenuated or attenuated less than signal components from said other directions;

the binaural hearing assistance system being configured to allow a user to indicate a direction to or a location of a target signal source relative to the user via said user interface.

This may have the advantage that interaural cues of the target signals are maintained, even in noisy situations, so that the target source presented to the user sounds as if it originates from the correct direction, while the ambient noise is reduced.

In the present context, the term 'beamforming' ('beamformer') is taken to mean (provide) a 'spatial filtering' of a number of inputs sensor signals with the aim of attenuating signal components from certain angles relative to signal components from other angles in a resulting beamformed signal. 'Beamforming' is taken to include the formation of linear combinations of a number of sensor input signals (e.g. microphone signals), e.g. on a time-frequency unit basis, e.g. in a predefined or dynamic/adaptive procedure.

The term 'to allow a user to indicate a direction to or a location of a target signal source relative to the user' is in the present context taken to include a direct indication by the user (e.g. pointing to a location of the audio source, or giving in data defining the position of the target sound source relative to the user) and/or an indirect indication, where the information is derived from a user's behavior (e.g. via a movement sensor monitoring the user's movements or orientation, or via electric signals from a user's brain, e.g. via EEG-electrodes).

If signal components from the direction of the target signal source are not left un-attenuated, but are indeed attenuated less than signal components from other directions than the direction of the target signal, the system is preferably configured to provide that such attenuation is (essentially) identical in the left and right hearing assistance devices. This has the advantage that interaural cues of the target signals can be maintained, even in noisy situations, so that the target source presented to the user sounds as if it originates from the correct direction, while the ambient noise is reduced.

In an embodiment, the binaural hearing assistance system is adapted to synchronize the respective multi-channel beamformer filtering units of the left and right hearing assistance devices so that both beamformer filtering units focus on the location in space of the target signal source. Preferably, the beamformers of the respective left and right hearing assistance devices are synchronized, so that they focus on the same location in space, namely the location of the target signal source. The term 'synchronized' is in the present context taken to mean that data relevant data are exchanged between the two devices, the data are compared, and a resulting data set determined based on the comparison.

In an embodiment, the information communicated and shared between the left and right hearing assistance devices includes information of the direction and/or distance to the target source.

In an embodiment, the user interface forms part of the left and/or right hearing assistance devices. In an embodiment, the user interface is implemented in the left and/or right hearing assistance devices. In an embodiment, at least one of the left and right hearing assistance devices comprises an activation element allowing a user to indicate a direction to or a location of a target signal source. In an embodiment, each of the left and right hearing assistance devices comprises an activation element, e.g. allowing a given angle deviation from the front direction in to the left or right of the user to be indicated by a corresponding number of activations of the activation element on the relevant of the two hearing assistance devices.

In an embodiment, the user interface forms part of an auxiliary device. In an embodiment, the user interface is fully or partially implemented in or by the auxiliary device. In an embodiment, the auxiliary device is or comprises a remote control of the hearing assistance system, a cellular telephone, a smartwatch, glasses comprising a computer, a tablet computer, a personal computer, a laptop computer, a notebook computer, phablet, etc., or any combination thereof. In an embodiment, the auxiliary device comprises a SmartPhone. In an embodiment, a display and activation elements of the SmartPhone form part of the user interface.

In an embodiment, the function of indicating a direction to or a location of a target signal source relative to the user is implemented via an APP running on the auxiliary device and an interactive display (e.g. a touch sensitive display) of the auxiliary device (e.g. a SmartPhone).

In an embodiment, the function of indicating a direction to or a location of a target signal source relative to the user is implemented by an auxiliary device comprising a pointing device (e.g. pen, a telephone, an audio gateway, etc.) adapted to communicate wirelessly with the left and/or right hearing assistance devices. In an embodiment, the function of indicating a direction to or a location of a target signal source relative to the user is implemented by a unit for sensing a head tilt/movement, e.g. using gyroscope/accelerometer elements, e.g. located in the left and/or right hearing assistance devices, or even via a brain-computer interface, e.g. implemented using EEG electrodes located on parts of the left and/or right hearing assistance devices in contact with the user's head.

In an embodiment, the user interface comprises electrodes located on parts of the left and/or right hearing assistance devices in contact with the user's head. In an embodiment, the system is adapted to indicate a direction to or a location of a target signal source relative to the user based on brain wave signals picked up by said electrodes. In an embodiment, the electrodes are EEG-electrodes. In an embodiment, one or more electrodes are located on each of the left and right hearing assistance devices. In an embodiment, one or more electrodes is/are fully or partially implanted in the head of the user. In an embodiment, the binaural hearing assistance system is configured to exchange the brain wave signals (or signals derived therefrom) between the left and right hearing assistance devices. In an embodiment, an estimate of the location of the target sound source is extracted from the brainwave signals picked up by the EEG electrodes of the left and right hearing assistance devices.

In an embodiment, the binaural hearing assistance system is adapted to allow an interaural wireless communication link between the left and right hearing assistance devices to be established to allow exchange of data between them. In an embodiment, the system is configured to allow data related to the control of the respective multi-microphone noise reduction systems (e.g. including data related to the direction to or location of the target sound source) to be exchanged between the hearing assistance devices. In an embodiment, the interaural wireless communication link is based on near-field (e.g. inductive) communication. Alternatively, the interaural wireless communication link is based on far-field (e.g. radiated fields) communication e.g. according to Bluetooth or Bluetooth Low Energy or similar standard.

In an embodiment, the binaural hearing assistance system is adapted to allow an external wireless communication link between the auxiliary device and the respective left and right hearing assistance devices to be established to allow exchange of data between them. In an embodiment, the system is configured to allow transmission of data related to the direction to or location of the target sound source to each (or one) of the left and right hearing assistance devices. In an embodiment, the external wireless communication link is based on near-field (e.g. inductive) communication. Alternatively, the external wireless communication link is based on far-field (e.g. radiated fields) communication e.g. according to Bluetooth or Bluetooth Low Energy or similar standard.

In an embodiment, the binaural hearing assistance system is adapted to allow an external wireless communication link (e.g. based on radiated fields) as well as an interaural wireless link (e.g. based on near-field communication) to be established. This has the advantage of improving reliability and flexibility of the communication between the auxiliary device and the left and right hearing assistance devices.

In an embodiment, each of said left and right hearing assistance devices further comprises a single channel post-processing filter unit operationally coupled to said multi-channel beamformer filtering unit and configured to provide an enhanced signal $\hat{S}(k,m)$. An aim of the single channel post filtering process is to suppress noise components from the target direction (which has not been suppressed by the spatial filtering process (e.g. an MVDR beamforming process). It is a further aim to suppress noise components during time periods where the target signal is present or dominant (as e.g. determined by a voice activity detector) as well as when the target signal is absent. In an embodiment, the single channel post filtering process is based on an estimate of a target signal to noise ratio for each time-frequency tile (m,k). In an embodiment, the estimate of the target signal to noise ratio for each time-frequency tile (m,k) is determined from the beamformed signal and the target-cancelled signal. The enhanced signal $\hat{S}(k,m)$ thus represents a spatially filtered (beamformed) and noise reduced version of the current input signals (noise and target). Intentionally, the enhanced signal $\hat{S}(k,m)$ represents an estimate of the target signal, whose direction has been indicated by the user via the user interface.

Preferably, the beamformers (multi-channel beamformer filtering units) are designed to deliver a gain of 0 dB for signals originating from a given direction/distance (e.g. a given φ, d pair), while suppressing signal components originating from any other spatial location. Alternatively, the beamformers are designed to deliver a larger gain (smaller attenuation) for signals originating from a given (target) direction/distance data (e.g. φ, d pair), than signal components originating from any other spatial location. Preferably, the beamformers of the left and right hearing assistance devices are configured to apply the same gain (or attenuation) to signal components from the target signal source (so that any spatial cues in the target signal are not obscured by the beamformers). In an embodiment, the multi-channel beamformer filtering unit of each of the left and right hearing assistance devices comprises a linearly constrained minimum variance (LCMV) beamformer. In an embodiment, the beamformers are implemented as minimum variance distortionless response (MVDR) beamformers.

In an embodiment, the multi-channel beamformer filtering unit of each of the left and right hearing assistance devices comprises an MVDR filter providing filter weights $w_{mvdr}(k,m)$, said filter weights $w_{mvdr}(k,m)$ being based on a look vector d(k,m) and an inter-input unit covariance matrix $R_{vv}(k,m)$ for the noise signal. MVDR is an abbreviation of Minimum Variance Distortion-less Response, Distortion-less indicating that the target direction is left unaffected; Minimum Variance: indicating that signals from any other direction than the target direction is maximally suppressed.

The look vector d is a representation of the (e.g. relative) acoustic transfer function from a (target) sound source to each input unit (e.g. a microphone), while the hearing aid device is in operation. The look vector is preferably determined (e.g. in advance of the use of the hearing device or adaptively) while a target (e.g. voice) signal is present or dominant (e.g. present with a high probability, e.g. ≥70%) in the input sound signal. Inter-input (e.g. microphone) covariance matrices and an eigenvector corresponding to a dominant eigenvalue of the covariance matrix are determined based thereon. The eigenvector corresponding to the dominant eigenvalue of the covariance matrix is the look vector d. The look vector depends on the relative location of the target signal to the ears of the user (where the hearing aid devices are assumed to be located). The look vector therefore represents an estimate of the transfer function from the target sound source to the hearing device inputs (e.g. to each of a number of microphones).

In an embodiment, the multi-channel beamformer filtering unit and/or the single channel post-processing filter unit is/are configured to maintain interaural spatial cues of the target signal. In an embodiment, the interaural spatial cues of the target source are maintained, even in noisy situations. Hence, the target signal source presented to the user sounds as if originating from the correct direction, while the ambient noise is reduced. In other words, the target component reaching each eardrum (or, rather, microphone) is maintained in the beamformer outputs, leading to preservation of the interaural cues for the target component. In an embodiment, the outputs of the multi-channel beamformer units are processed by single channel post-processing filter units (SC-NR) in each of the left and right hearing assistance devices. If these SC-NRs operate independently and uncoordinated, they may distort the interaural cues of the target component, which may lead to distortions in the perceived location of the target source. To avoid this, the SC-NR systems may preferably exchange their estimates of their (time-frequency dependent) gain values, and decide on using the same, for example the largest of the two gain values for a particular time-frequency unit (k,m). In this way, the suppression applied to a certain time-frequency unit is the same in the two ears, and no artificial inter-aural level differences are introduced.

In an embodiment, each of the left and right hearing assistance devices comprises a memory unit comprising a number of predefined look vectors, each corresponding to the beamformer pointing in and/or focusing at a predefined direction and/or location.

In an embodiment, the user provides information about target direction (phi, φ) of and distance (range, d) to the target signal source via the user interface. In an embodiment, the number of (sets of) predefined look vectors stored in the memory unit correspond to a number of (sets of) specific values of target direction (phi, φ) and distance (range, d). As the beamformers of the left and right hearing assistance devices are synchronized (via a communication link between the devices), both beamformers focus at the same spot (or spatial location). This has the advantage that the user provides the direction/location of the target source, and thereby selects a corresponding (predetermined) look vector (or a set of beamformer weights) to be applied in the current acoustic situation.

In an embodiment, each of the left and right hearing assistance devices comprises a voice activity detector for identifying respective time segments of an input signal where a human voice is present. In an embodiment, the hearing assistance system is configured to provide that the information communicated and shared between the left and right hearing assistance devices include voice activity detector (VAD) values or decisions, and gain values applied by the single-channel noise reduction systems, for improved performance. A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only comprising other sound sources (e.g. artificially generated noise). In an embodiment, the voice detector is adapted to detect as a VOICE also the user's own voice. Alternatively, the voice detector is adapted to exclude a user's own voice from the detection of a VOICE. In an embodiment, the binaural hearing assistance system is adapted to base the identification of respective time segments of an input signal where a human voice is present at least partially (e.g. solely) on brain wave signals. In an embodiment, the binaural hearing assistance system is adapted to base the identification of respective time segments of an input signal where a human voice is present on a combination of brain wave signals and signals form one or more of the multitude of input units, e.g. on one or more microphones. In an embodiment, the binaural hearing assistance system is adapted to pick up the brain-wave signals using electrodes located on parts of the left and/or right hearing assistance devices in contact with the user's head (e.g. positioned in an ear canal).

In an embodiment, at least one, such as a majority, e.g. all, of said multitude of input units $IU_i$ of the left and right hearing assistance devices comprises a microphone for converting an input sound to an electric input signal $x_i(n)$ and a time to time-frequency conversion unit for providing a time-frequency representation $X_i(k,m)$ of the input signal $x_i(n)$ at the $i^{th}$ input unit $IU_i$ in a number of frequency bands k and a number of time instances m. Preferably, the binaural hearing assistance system comprises at least two microphones in total, e.g. at least one in each of the left and right hearing assistance devices. In an embodiment, each of the left and right hearing assistance devices comprises M input units $IU_i$ in the form of microphones which are physically located in the respective left and right hearing assistance devices (or at least at the respective left and right ears). In an embodiment, M is equal to two. Alternatively, at least one of the input units providing a time-frequency representation of the input signal to one of the left and right hearing assistance devices receives its input signal from another physical device, e.g. from the respective other hearing assistance device, or from an auxiliary device, e.g. a cellular telephone, or from a remote control device for controlling the hearing assistance device, or from a dedicated extra microphone device (e.g. specifically located to pick up a target signal or a noise signal).

In an embodiment, the binaural hearing assistance system is adapted to provide a frequency dependent gain to compensate for a hearing loss of a user. In an embodiment, the left and right hearing assistance devices each comprises a signal processing unit for enhancing the input signals and providing a processed output signal.

In an embodiment, the hearing assistance device comprises an output transducer for converting an electric signal to a stimulus perceived by the user as an acoustic signal. In an embodiment, the output transducer comprises a number of electrodes of a cochlear implant or a vibrator of a bone conducting hearing device. In an embodiment, the output transducer comprises a receiver (speaker) for providing the stimulus as an acoustic signal to the user.

In an embodiment, the left and right hearing assistance devices are portable device, e.g. a device comprising a local energy source, e.g. a battery, e.g. a rechargeable battery.

In an embodiment, the left and right hearing assistance devices each comprises a forward or signal path between an input transducer (microphone system and/or direct electric input (e.g. a wireless receiver)) and an output transducer. In an embodiment, the signal processing unit is located in the forward path. In an embodiment, the signal processing unit is adapted to provide a frequency dependent gain according to a user's particular needs. In an embodiment, the left and right hearing assistance device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, the left and right hearing assistance devices comprise an analogue-to-digital (AD) converter to digitize an analogue input with a predefined sampling rate, e.g. 20 kHz. In an embodiment, the hearing assistance devices comprise a digital-to-analogue (DA) converter to convert a digital signal to an analogue output signal, e.g. for being presented to a user via an output transducer.

In an embodiment, the left and right hearing assistance devices, e.g. the input unit, e.g. a microphone unit, and or a transceiver unit, comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain. In an embodiment, the frequency range considered by the hearing assistance device from a minimum frequency $f_{min}$ to a maximum frequency $f_{max}$ comprises a part of the typical human audible frequency range from 20 Hz to 20 kHz, e.g. a part of the range from 20 Hz to 12 kHz. In an embodiment, a signal of the forward and/or analysis path of the hearing assistance device is split into a number NI of frequency bands, where NI is e.g. larger than 5, such as larger than 10, such as larger than 50, such as larger than 100, such as larger than 500, at least some of which are processed individually.

In an embodiment, the left and right hearing assistance devices comprises a level detector (LD) for determining the level of an input signal (e.g. on a band level and/or of the full (wide band) signal). The input level of the electric microphone signal picked up from the user's acoustic environment is e.g. a classifier of the environment. In an embodiment, the level detector is adapted to classify a current acoustic environment of the user according to a number of different (e.g. average) signal levels, e.g. as a HIGH-LEVEL or LOW-LEVEL environment.

In an embodiment, the left and right hearing assistance devices comprises a correlation detector configured to estimate auto-correlation of a signal of the forward path, e.g. an electric input signal. In an embodiment, the correlation detector is configured to estimate auto-correlation of a feedback corrected electric input signal. In an embodiment, the correlation detector is configured to estimate auto-correlation of the electric output signal.

In an embodiment, the correlation detector is configured to estimate cross-correlation between two signals of the forward path, a first signal tapped from the forward path before the signal processing unit (where a frequency dependent gain may be applied), and a second signal tapped from the forward path after the signal processing unit. In an embodiment, a first of the signals of the cross-correlation calculation is the electric input signal, or a feedback corrected input signal. In an embodiment, a second of the signals of the cross-correlation calculation is the processed output signal of the signal processing unit or the electric output signal (being fed to the output transducer for presentation to a user).

In an embodiment, the left and right hearing assistance devices comprises an acoustic (and/or mechanical) feedback detection and/or suppression system. In an embodiment, the hearing assistance device further comprises other relevant functionality for the application in question, e.g. compression, etc.

In an embodiment, the left and right hearing assistance devices comprises a listening device, e.g. a hearing aid, e.g. a hearing instrument, e.g. a hearing instrument adapted for being located at the ear or fully or partially in the ear canal of a user, or for being fully or partially implanted in the head of a user, a headset, an earphone, an ear protection device or a combination thereof.

Use:

In an aspect, use of a binaural hearing assistance system as described above, in the 'detailed description of embodiments' and in the claims, is moreover provided. In an embodiment, use in a binaural hearing aid system is provided.

A Method:

In an aspect, a method of operating a binaural hearing assistance system, the system comprising left and right hearing assistance devices adapted for being located at or in left and right ears of a user, or adapted for being fully or partially implanted in the head of the user, the binaural hearing assistance system further comprising a user interface configured to communicate with said left and right hearing assistance devices and to allow a user to influence functionality of the left and right hearing assistance devices is furthermore provided by the present application. The method comprises in each of the left and right hearing assistance devices a) providing a time-frequency representation Xi(k,m) of an input signal xi(n) at an ith input unit in a number of frequency bands and a number of time instances, k being a frequency band index, m being a time index, n representing time, M being larger than or equal to two, for the time-frequency representation Xi(k,m) of the ith input signal comprising a target signal component and a noise signal component, the target signal component originating from a target signal source;

b) providing a beamformed signal Y(k,m) from said time-frequency representations Xi(k,m) of said multitude of input signals, wherein signal components from other directions than a direction of a target signal source are attenuated, whereas signal components from the direction of the target signal source are left un-attenuated or are attenuated less than signal components from said other directions in said beamformed signal Y(k,m); and configuring the binaural hearing assistance system to allow a user to indicate a direction to or a location of a target signal source relative to the user via said user interface.

It is intended that some or all of the structural features of the system described above, in the 'detailed description of embodiments' or in the claims can be combined with embodiments of the method, when appropriately substituted by a corresponding process and vice versa. Embodiments of the method have the same advantages as the corresponding systems.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application. In addition to being stored on a tangible medium such as diskettes, CD-ROM-, DVD-, or hard disk media, or any other machine readable medium, and used when read directly from such tangible media, the computer program can also be transmitted via a transmission medium such as a wired or wireless link or a network, e.g. the Internet, and loaded into a data processing system for being executed at a location different from that of the tangible medium.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

Definitions

In the present context, a 'hearing assistance device' refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing assistance device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing assistance device may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The hearing assistance device may comprise a single unit or several units communicating electronically with each other.

More generally, a hearing assistance device comprises an input transducer for receiving an acoustic signal from a user's surroundings and providing a corresponding input audio signal and/or a receiver for electronically (i.e. wired or wirelessly) receiving an input audio signal, a signal processing circuit for processing the input audio signal and an output means for providing an audible signal to the user in dependence on the processed audio signal. In some hearing assistance devices, an amplifier may constitute the signal processing circuit. In some hearing assistance devices, the output means may comprise an output transducer, such as e.g. a loudspeaker for providing an air-borne acoustic signal or a vibrator for providing a structure-borne or liquid-borne acoustic signal. In some hearing assistance devices, the output means may comprise one or more output electrodes for providing electric signals.

In some hearing assistance devices, the vibrator may be adapted to provide a structure-borne acoustic signal transcutaneously or percutaneously to the skull bone. In some hearing assistance devices, the vibrator may be implanted in the middle ear and/or in the inner ear. In some hearing assistance devices, the vibrator may be adapted to provide a structure-borne acoustic signal to a middle-ear bone and/or to the cochlea. In some hearing assistance devices, the vibrator may be adapted to provide a liquid-borne acoustic signal to the cochlear liquid, e.g. through the oval window. In some hearing assistance devices, the output electrodes may be implanted in the cochlea or on the inside of the skull bone and may be adapted to provide the electric signals to the hair cells of the cochlea, to one or more hearing nerves, to the auditory cortex and/or to other parts of the cerebral cortex.

A 'hearing assistance system' refers to a system comprising one or two hearing assistance devices, and a 'binaural hearing assistance system' refers to a system comprising two hearing assistance devices and being adapted to cooperatively provide audible signals to both of the user's ears. Hearing assistance systems or binaural hearing assistance systems may further comprise 'auxiliary devices', which communicate with the hearing assistance devices and affect and/or benefit from the function of the hearing assistance devices. Auxiliary devices may be e.g. remote controls, audio gateway devices, mobile phones, public-address systems, car audio systems or music players. Hearing assistance devices, hearing assistance systems or binaural hearing assistance systems may e.g. be used for compensating for a hearing-impaired person's loss of hearing capability, augmenting or protecting a normal-hearing person's hearing capability and/or conveying electronic audio signals to a person.

Further objects of the application are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element or intervening elements may be present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The disclosure will be explained more fully below in connection with a preferred embodiment and with reference to the drawings in which.

The figures are schematic and simplified for clarity, and they just show details which are essential to the understanding of the disclosure, while other details are left out. Throughout, the same reference signs are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

FIG. 1A, 1B, 1C, 1D show four embodiments of a binaural hearing assistance system (BHAS) comprising left ($HAD_l$) and right ($HAD_r$) hearing assistance devices adapted for being located at or in left and right ears of a user, or adapted for being fully or partially implanted in the head of the user. The binaural hearing assistance system (BHAS) further comprises a user interface (UI) configured to communicate with the left and right hearing assistance devices thereby allowing a user to influence functionality of the system and the left and right hearing assistance devices.

Figure 1A:
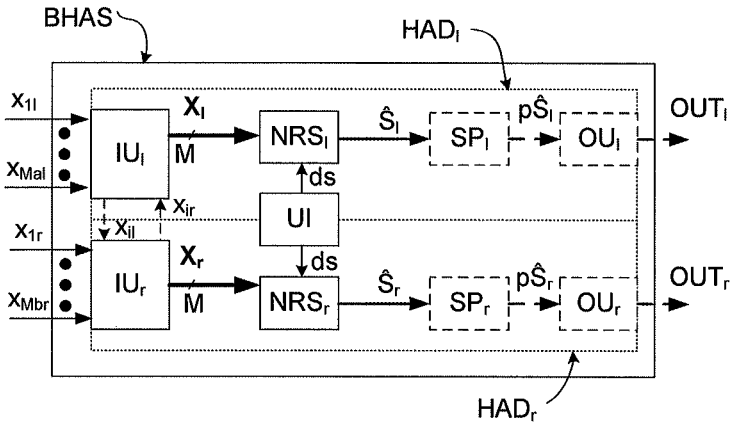
FIGS. 1A-1D show four embodiments (FIGS. 1A, 1B, 1C and 1D) of a binaural hearing assistance system comprising left and right hearing assistance devices, each comprising binaurally synchronized beamformer/noise reduction systems via a user interface.

The solid-line blocks (input units $IU_l$, $IU_r$), (noise reduction systems $NRS_l$, $NRS_r$) and (user interface UI) of the embodiment of FIG. 1*a* constitute the basic elements of a hearing assistance system (BHAS) according to the present disclosure. Each of the left ($HAD_l$) and right ($HAD_r$) hearing assistance devices comprises a multitude of input units $IU_i$, i=1, . . . , M, M being larger than or equal to two (represented in FIG. 1A by left and right input units $IU_l$, and $IU_r$, respectively). The respective input units $IU_l$, $IU_r$ provide a time-frequency representation $X_i(k,m)$ (signals $X_l$ and $X_r$ in FIG. 1A, each representing M signals of the left and right hearing assistance devices, respectively) of an input signal $x_i(n)$ (signals $x_{1l}, \ldots, x_{Mal}$, and $x_{1r}, \ldots, x_{Mbr}$, respectively, in FIG. 1A), at an $i^{th}$ input unit in a number of frequency bands and a number of time instances, k being a frequency band index, m being a time index, n representing time. The number of input units of each of the left and right hearing assistance devices is assumed to be M. Alternatively, the number of input units of the two devices may be different. However, as indicated in FIG. 1A by optional sensor signals $x_{il}$, $x_{ir}$ from the left to the right and from the right to the left hearing assistance device, respectively, sensor signals ($x_{il}$, $x_{ir}$ e.g. microphone signals) picked up by a device at one ear may be communicated to the device at the other ear and used as an input the multi-input unit noise reduction system (NRS) of the hearing assistance device in question. Such communication of signals between the devices may be via a wired connection or, preferably, via a wireless link (cf. e.g. IA-WL in FIGS. 2 and 6A). Further, sensor signals (e.g. microphone signals) picked up at a further communication device (e.g. a wireless microphone, or a microphone of a cellular telephone, etc.), may be communicated to and used as an input to the multi-input unit noise reduction system (NRS) of one or both hearing assistance devices of the system (cf. e.g. antenna and transceiver circuitry ANT, RF-Rx/Tx in FIG. 2B or communication link WL-RF in FIG. 6A). The time dependent inputs signals $x_i(n)$ and the time-frequency representation $X_i(k,m)$ of the $i^{th}$ input signal (i=1, . . . , M) comprises a target signal component and a noise signal component, the target signal component originating from a target signal source. Preferably the time dependent input signals $x_{il}(n)$ and $x_{ir}(n)$ are signals originating from acoustic signals received at the respective left and right ears of the user (to include spatial cues related to the head and body of the user). Each of the left ($HAD_l$) and right ($HAD_r$) hearing assistance devices comprises a multi-input unit noise reduction system ($NRS_l$, $NRS_r$) comprising a multi-channel beamformer filtering unit operationally coupled to said multitude of input units $IU_i$, i=1, . . . , M, ($IU_l$ and $IU_r$) of the left and right hearing assistance devices and configured to provide a (resulting) beamformed signal $\hat{S}(k,m)$, ($\hat{S}_l$, $\hat{S}_r$ in FIG. 1A), wherein signal components from other directions than a direction of a target signal source are attenuated, whereas signal components from the direction of the target signal source are left un-attenuated or attenuated less than signal components from said other directions. Further, the binaural hearing assistance system (BHAS) is configured to allow a user to indicate a direction to or a location of a target signal source relative to the user via the user interface (IU), cf. signal ds from the user interface to the multi-input unit noise reduction systems ($NRS_l$, $NRS_r$) of the left and right hearing assistance devices, respectively. The user interface may e.g. comprise respective activation elements on the left and right hearing assistance devices. In an embodiment, the system is configured to provide that an activation on the left hearing assistance devices (HAD) represents a predetermined angle-step (e.g. 30°) in a first (e.g. anti-clockwise) direction of the direction from the user to the target signal source (from a present state; e.g. starting from a front direction, e.g. $\varphi_s$=0° in FIG. 4A, $\varphi_4$=0° in FIG. 5) and that an activation on the right hearing assistance devices ($HAD_r$) represents a predetermined angle-step (e.g. 30°) in a second (opposite, e.g. a clockwise) direction. For each predefined direction, corresponding predefined filter weights for the beamformer filtering unit are stored in the system and applied according to the current indication of the user (cf. discussion in connection with FIG. 5). Other user interfaces are of course possible, e.g. implemented in a separate (auxiliary) device, e.g. a SmartPhone (see e.g. FIG. 6).

The dashed-line blocks of FIG. 1A (signal processing units $SP_l$, $SP_r$) and (output units $OU_l$, $OI_r$) represent optional further functions forming part of an embodiment of the hearing assistance system (BHAS). The signal processing units ($SP_l$, $SP_r$) may e.g. provide further processing of the beamformed signal ($\hat{S}_l$, $\hat{S}_r$), e.g. applying a (time-/level-, and) frequency dependent gain according to the needs of the user (e.g. to compensate for a hearing impairment of the user) and provide a processed output signal ($p\hat{S}_l$, $p\hat{S}_r$). The output units ($OU_l$, $OI_r$) are preferably adapted to provide a resulting electric signal (e.g. respective processed output signal ($p\hat{S}_l$, $p\hat{S}_r$)) of the forward path of the left and right hearing assistance devices as stimuli perceivable to the user as sound representing the resulting electric (audio signal) of the forward path.

Figure 1B:
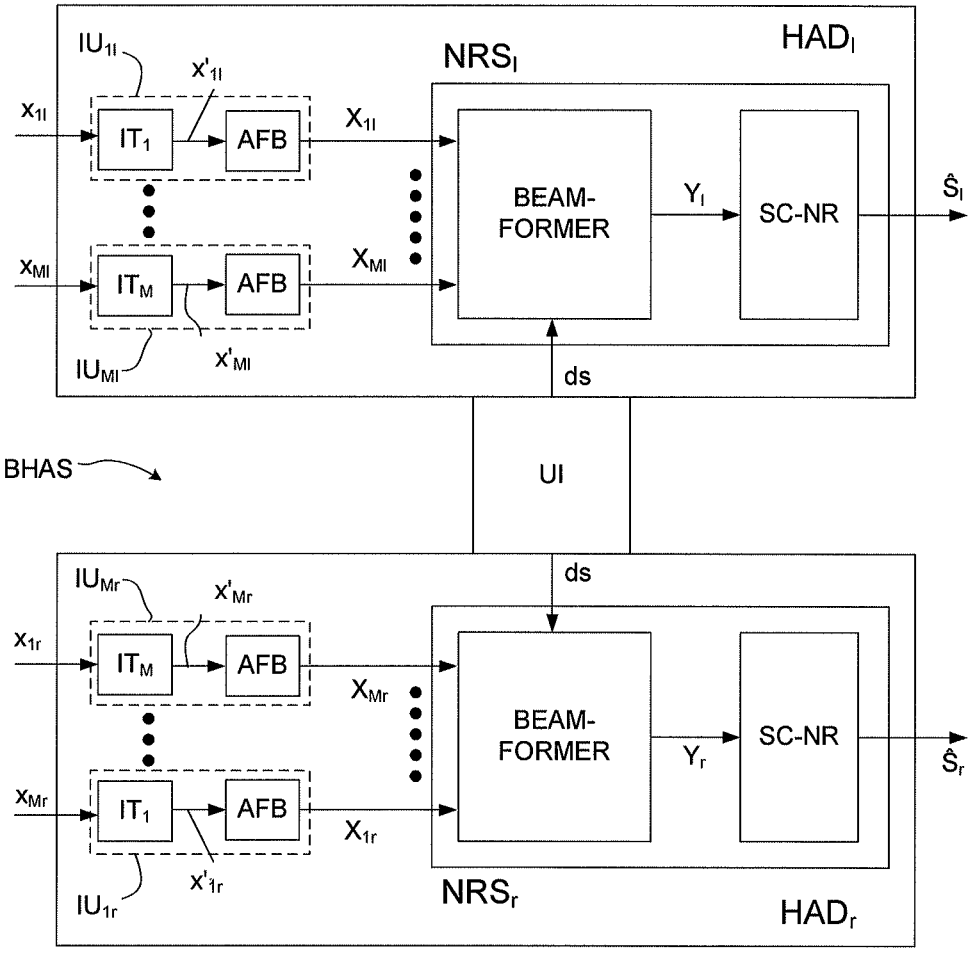

FIG. 1B shows an embodiment of a binaural hearing assistance system (BHAS) comprising left ($HAD_l$) and right ($HAD_r$) hearing assistance devices according to the present disclosure. Compared to the embodiment of FIG. 1A, the embodiment of FIG. 1B does not include the optional (dashed-line) components, and the input units $IU_l$ and $IU_r$ are detailed out in separate input units ($IU_{1l}, \ldots, IU_{Ml}$) and ($IU_{1r}, \ldots, IU_{Mr}$), of the left and right hearing assistance devices, respectively. Each input unit $IU_i$ ($IU_{il}$ and $IU_{ir}$) comprises an input transducer or receiver $IT_i$ for transforming a sound signal $x_i$ to an electric input signal $x'_i$ or for receiving an electric input signal representing a sound signal. Each input unit $IU_i$ further comprises a time to time-frequency transformation unit, e.g. an analysis filter-bank (AFB) for splitting the electric input signal ($x'_i$) into a number of frequency bands (k) providing signal $X_i$ ($X_{il}$, $X_{ir}$). Further, the multi-input unit noise reduction systems ($NRS_l$, $NRS_r$) of the left and right hearing assistance devices each comprises a multi-channel beamformer filtering unit (BEAMFORMER, e.g. an MVDR beamformer) providing beamformed signal Y ($Y_l$, $Y_r$) and additionally a single-channel post-processing filter unit (SC-NR) providing enhanced (beamformed and noise reduced) signal $\hat{S}$ ($\hat{S}_l$, $\hat{S}_r$). The single-channel post-processing filter unit (SC-NR) is operationally coupled to the multi-channel beamformer filtering unit (BEAMFORMER) and configured to provide an enhanced signal $\hat{S}(k,m)$. A purpose of the single-channel post-processing filter unit (SC-NR) is to suppress noise components from the target direction, which have not been suppressed by the multi-channel beamformer filtering unit (BEAMFORMER).

Figure 1C:
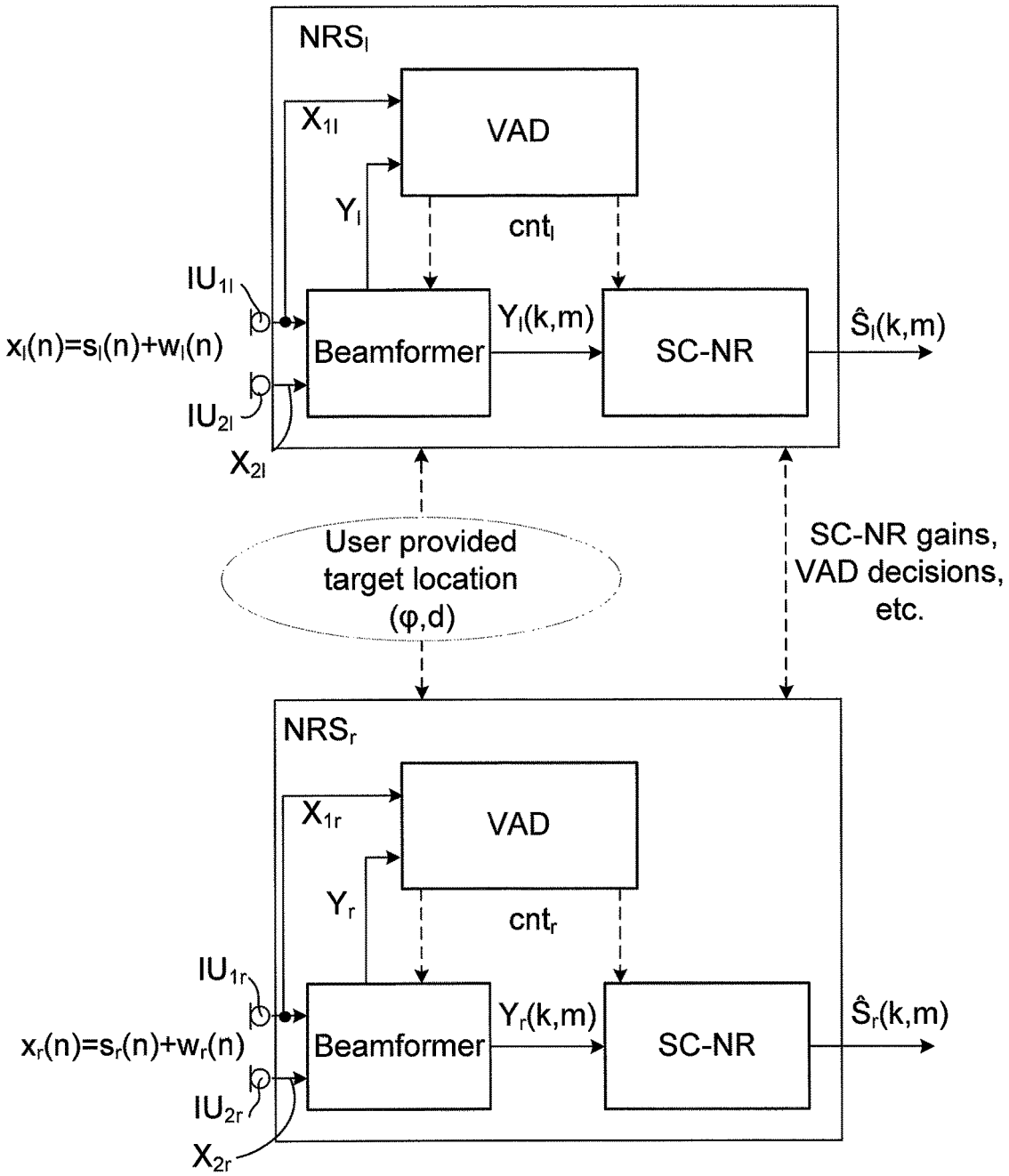

FIG. 1C shows a third embodiment of a binaural hearing assistance system comprising left ($HAD_l$) and right ($HAD_r$) hearing assistance devices with binaurally synchronized beamformer/noise reduction systems ($NRS_l$, $NRS_r$). In the embodiment of FIG. 1C, each of the left and right hearing assistance devices comprises two input units, ($IU_{1l}$, $IU_{2l}$) and ($IU_{rl}$, $IU_{2r}$), respectively, here microphone units. It is assumed that the described system works in parallel in several frequency sub-bands, but the analysis/synthesis filter banks needed to achieve this have been suppressed in FIG. 1C (shown in FIG. 1B). The user provides information about target direction (φ=phi) and distance (d=range) via a user interface (cf. indication User provided target location (ω,d) in FIG. 1C), and e.g. definitions in FIG. 3 and example of a user interface (UI) for providing this information in FIG. 1A and FIG. 6). The hearing assistance system uses this information to find—in a pre-computed database (memory) of look vectors and/or beamformer weights—the beamformer pointing in/focusing at the correct direction/range, cf. exemplary predefined directions and ranges in FIG. 5. As the left-ear and right-ear beamformers are synchronized, both beamformers focuses at the same spot (cf. e.g. FIG. 4). The beamformers are e.g. designed to deliver a gain of 0 dB for signals originating from a given (phi,d) pair, while suppressing signal components originating from any other spatial location, i.e., they could be minimum variance distortionless response (MVDR) beamformers or, more generally, linearly constrained minimum variance (LCMV) beamformers. In other words, the target component reaching each eardrum (or, rather, microphone) is maintained in the beamformer outputs, $Y_l(k,m)$ and $Y_r(k,m)$, leading to preservation of the interaural cues for the target component. The beamformer outputs $Y_l(k,m)$, $Y_r(k,m)$ are fed to single-channel post-processing filter units (SC-NR) in each hearing assistance device for further processing. A task of the single-channel post-processing filter unit (SC-NR) is to suppress noise components during time periods, where the target signal is present or dominant (as e.g. determined by a voice activity detector, VAD, cf. signals $cnt_l$, $cnt_r$) as well as when the target signal is absent (as also indicated by the VAD, cf. signals $cnt_l$, $cnt_r$). Preferably, the VAD-control signals $cnt_l$, $cnt_r$ (e.g. binary voice, no-voice, or soft, probability based dominant, non-dominant) are defined for each time-frequency tile (m,k). In an embodiment, the single-channel post filtering process is based on an estimate of a target signal to noise ratio for each time-frequency tile (m,k). Such SNR estimates may e.g. be based on the size of the modulation (e.g. a modulation index) in the respective beamformed signals $Y_l(k,m)$ and $Y_r(k,m)$. The signals $Y_l$, $Y_r$ from the Beam formers of the left and right hearing assistance devices, respectively, to the respective VADs are intended to allow the VAD to base its 'voice-no voice'-decision on the beamformed output signals ($Y_l$, $Y_r$) in addition to or rather as an alternative to the microphone signal(s) ($X_{1l}(X_{2l})$, $X_{1r}(X_{2r})$). In an embodiment, the beamformed signal is considered (weighted) in situations with relatively low signal to noise ratios (SNR).

Figure 1D:
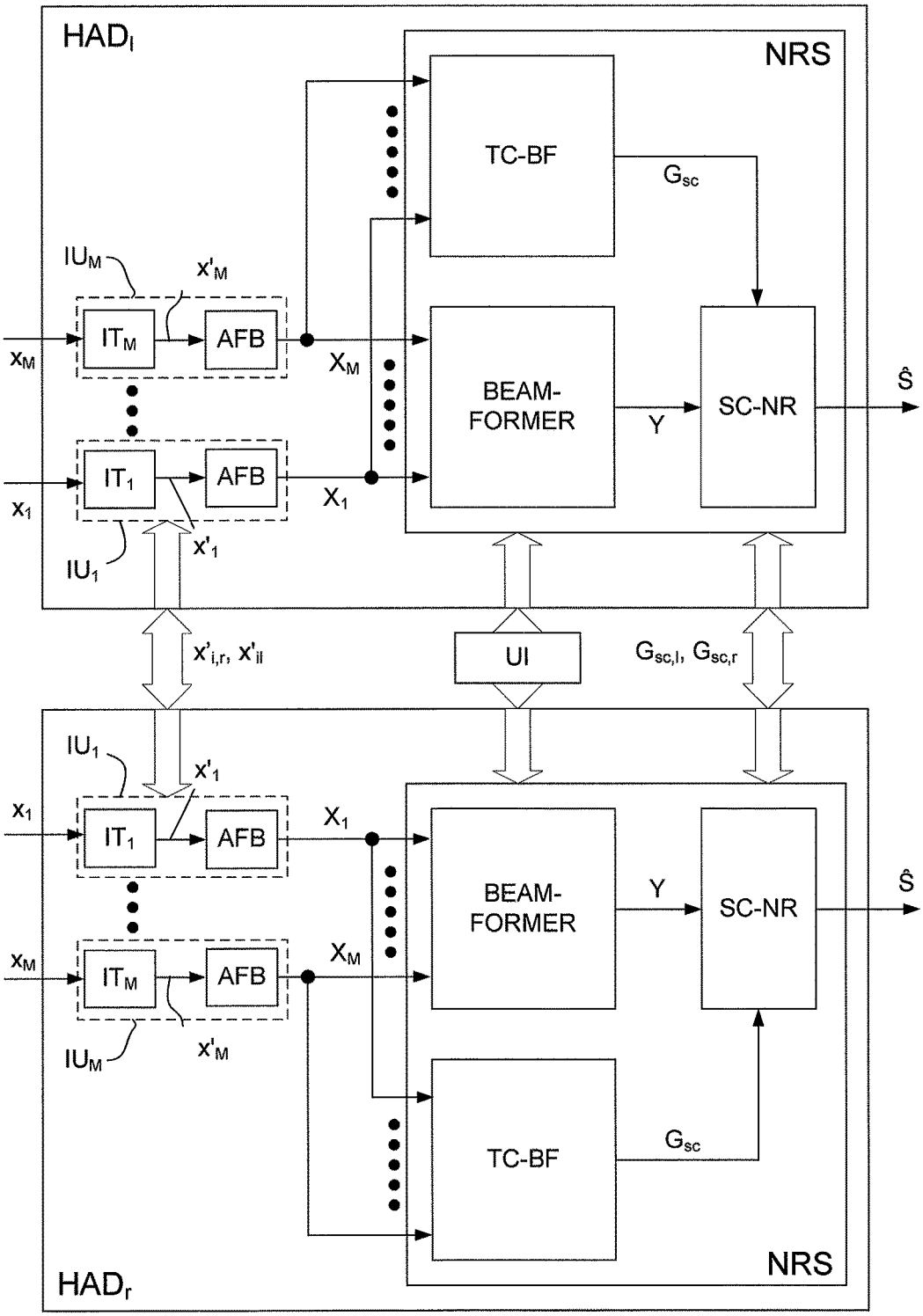

In an embodiment, the left and right hearing assistance devices ($HAD_l$, $HAD_r$) each comprise a target-cancelling beamformer TC-BF, as illustrated in FIG. 1D. In an embodiment, the left and right hearing assistance devices ($HAD_l$, $HAD_r$) each comprise a target-cancelling beamformer TC-BF, receiving inputs signals $X_1, \ldots, X_M$ and providing gains $G_{sc}$ to be applied to respective time-frequency units of the beamformed signal Y in the respective single-channel post-processing filter units (SC-NR) as illustrated in FIG. 1D. Compared to the embodiment of FIG. 1C, the embodiment of FIG. 1D further provides an optional exchange of (one or more) input unit signals $x'_{i,l}$ and $x'_{i,r}$ between the two hearing assistance devices, as indicated by the left arrow between the two devices. Preferably, the estimate of the target signal to noise ratio for each time-frequency tile (m,k) of the resulting signal $\hat{S}$ is determined from the beamformed signal Y and the target-cancelled signal (cf. gains $G_{sc}$ in FIG. 1D). If the single-channel post-processing filter units SC-NRs operate independently and uncoordinated, they may distort the interaural cues of the target component, which may lead to distortions in the perceived location of the target source. To avoid this, the SC-NR systems may exchange their estimates of their (time-frequency dependent) gain values (as indicated by SC-NR gains, VAD decisions, etc. in FIG. 1C and $G_{sc,l}$, $G_{sc,r}$ at the right arrow between the two devices in FIG. 1D), and decide on using the same, for example the largest of the two gain values for a particular time-frequency unit. In this way, the suppression applied to a certain time-frequency unit is the same in the two ears, and no artificial inter-aural level differences are introduced. The user interface (UI) for providing information about the look vector is indicated between the two hearing aid devices (at the middle arrow). The user interface may include or consist of sensors for extracting information about the current target sound source from the user (e.g. via EEG electrodes and/or movement sensors, etc., and signal processing thereof).

Figure 2A:
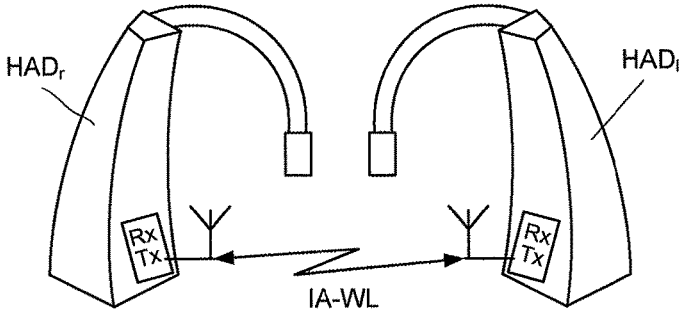
FIGS. 2A-2B show a fifth embodiment of a binaural hearing assistance system comprising left and right hearing assistance devices with binaurally synchronized beamformer/noise reduction systems, wherein the left and right hearing assistance devices comprises antenna and transceiver circuitry for establishing an interaural communication link between the two devices, FIG. 2A showing exemplary left and right hearing assistance devices, and FIG. 2B showing corresponding exemplary block diagrams, FIGS. 3A, 3B, 3C and 3D schematically illustrate examples of a mutual location in space of elements of a binaural hearing assistance system and/or a sound source relative to a user, represented in a spherical and an orthogonal coordinate system, FIGS. 4A-4B schematically show two examples of locations of a target sound source relative to a user, FIG. 4A right in front of the user, and FIG. 4B in the quadrant ($x>0$, $y>0$) to the left of the user, FIG. 5 schematically shows a number of predefined orientations of the look vector relative to a user.
Figure 2B:
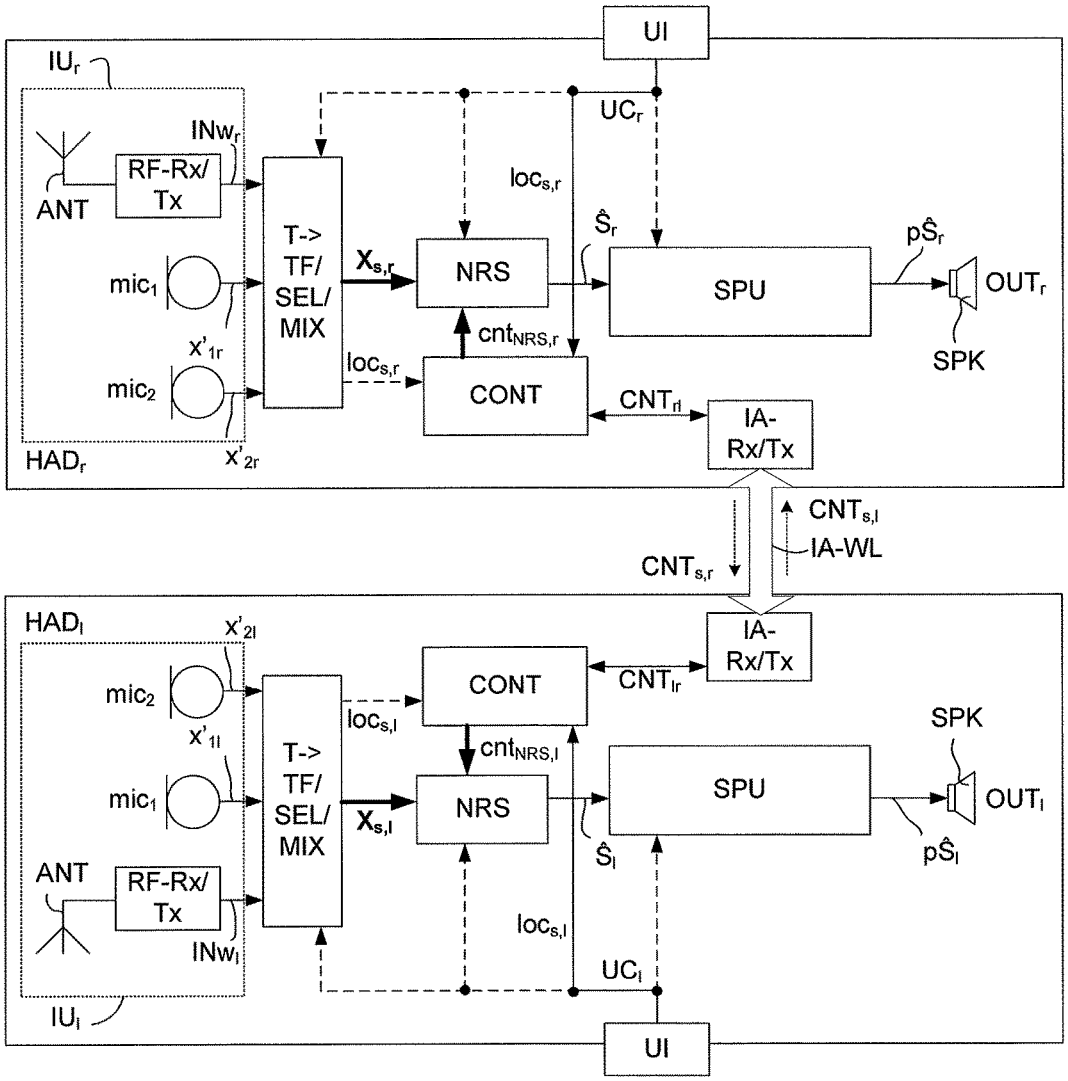

FIG. 2 shows a fifth embodiment of a binaural hearing assistance system comprising left and right hearing assistance devices with binaurally synchronized beamformer/noise reduction systems, wherein the left and right hearing assistance devices comprises antenna and transceiver circuitry for establishing an interaural communication link between the two devices, FIG. 2A showing exemplary left and right hearing assistance devices, and FIG. 2B showing corresponding exemplary block diagrams.

FIG. 2A shows an example of a binaural listening system comprising first and second hearing assistance devices $HAD_l$, $HAD_r$. The hearing assistance devices are adapted to exchange information via wireless link IA-WL and antennas and transceivers RxTx. The information that can be exchanged between the two hearing assistance devices comprises e.g. sound (e.g. target) source localization information (e.g. a direction and possibly a distance, e.g. ($d_s$, $\theta_s$, $\varphi_s$), cf. e.g. FIG. 3C), beamformer weights, noise reduction gains (attenuations), detector signals (e.g. from a voice activity detector), control signals and/or audio signals (e.g. one or more (e.g. all) frequency bands of one or more audio signals). The first and second hearing assistance devices $HAD_l$, $HAD_r$ of FIG. 2A are shown as BTE-type devices, each comprising a housing adapted for being located behind an ear (pinna) of a user, the hearing assistance devices each comprising one or more input transducers, e.g. microphones ($mic_1$, $mic_2$), a signal processing unit (SPU) and an output unit (SPK) (e.g. an output transducer, e.g. a loudspeaker). In an embodiment, all of these components are located in the housing of the BTE-part. In such case the sound from the output transducer may be propagated to the ear canal of the user via a tube connected to a loudspeaker outlet of the BTE-part. The tube may be connected to an ear mould specifically adapted to the form of the users' ear canal and allowing sound signals from the loudspeaker to reach the ear drum of the ear in question. In an embodiment, the ear mould or other part located in or near the ear canal of the user comprises an input transducer, e.g. a microphone (e.g. located at the entrance to ear canal), which form part of or transmits its electric audio signal to an input unit of the corresponding hearing assistance device and thus may constitute one of the electric input signals that are used by the multi-microphone noise reduction system (NRS). Alternatively, the output transducer may be located separately from the BTE-part, e.g. in the ear canal of the user or in concha, and electrically connected to the signal processing unit of the BTE-part (e.g. via electric conductors or a wireless link).

FIG. 2B shows an embodiment of a binaural hearing assistance system, e.g. a binaural hearing aid system, comprising left and right hearing assistance devices ($HAD_l$, $HAD_r$), in the following termed hearing instruments. The left and right hearing instruments are adapted for being located at or in left and right ears of a user. Alternatively, the left and right hearing instruments may be adapted for being fully or partially implanted in the head of the user (e.g. to implement a bone vibrating (e.g. bone anchored) hearing instrument for mechanically vibrating bones in the head of the user, or to implement a cochlear implant type hearing instrument comprising electrodes for electrically stimulating the cochlear nerve in the left and right sides of the user's head). The hearing instruments are adapted for exchanging information between them via a wireless communication link, here via a specific inter-aural (IA) wireless link (IA-WL) implemented by corresponding antenna and transceiver circuitry (IA-Rx/Tx) of the left and right hearing instruments, respectively). The two hearing instruments ($HAD_l$, $HAD_r$) are e.g. adapted to allow the exchange of control signals $CNT_s$ including localization parameters $loc_s$ (e.g. direction and/or distance or absolute coordinates) of corresponding sound source signals $S_s$ between the two hearing instruments, cf. dotted arrows indicating a transfer of signals $CNT_{s,r}$ from the right to the left instrument and signals $CNT_{s,l}$ from the left to the right instruments. Each hearing instrument ($HAD_l$, $HAD_r$) comprises a forward signal path comprising input units (e.g. microphones and/or wired or wireless receivers) operatively connected to a signal processing unit (SPU) and one or more output units (here loudspeaker (SPK)). Between the input units ($mic_1$, $mic_2$) and the signal processing unit (SPU), and in operative connection with both, a time to time-frequency conversion unit (T->TF) and a multi-channel noise reduction system (NRS) are located. The time to time-frequency conversion unit (T->TF) provides time-frequency representations $X_i(k, m)$ ($X_{s,r}$ and $X_{s,l}$ in FIG. 2B) of (time variant) input signals $x'_i$ at the $i^{th}$ input unit, i=1, 2, (outputs of $mic_1$, $mic_2$) in a number of frequency bands k and a number of time instances m. The time-frequency representation $X_i(k,m)$ of the $i^{th}$ input signal is assumed to comprise a target signal component and a noise signal component, the target signal component originating from a target signal source $S_s$. The time to time-frequency conversion unit (T->TF) is in the embodiment of FIG. 2B integrated with a selection/mixing unit (SEL/MIX) for selecting the input units currently to be connected to the multi-channel noise reduction system (NRS). Different input units may e.g. be selected in different modes of operation of the binaural hearing assistance system. In the embodiment of FIG. 2B, each hearing instrument comprises a user interface (UI) allowing a user to control functionality of the respective hearing instruments, and/or of the binaural hearing assistance system (cf. dashed signal paths $UC_r$, $UC_l$, respectively). Preferably, the user interfaces (UI) allow a user to indicate a direction to or a location of ($loc_s$) a target signal source ($S_s$) relative to the user (U). In the embodiment of FIG. 2B, each hearing instrument ($HAD_l$, $HAD_r$) further comprises antenna and transceiver circuitry (ANT, RF-Rx/Tx) for receiving data from an auxiliary device (cf. e.g. AD in FIG. 6), the auxiliary device e.g. comprising the user interface (or an alternative or supplementary user interface) for the binaural hearing assistance system. Alternatively or additionally, the antenna and transceiver circuitry (ANT, RF-Rx/Tx) may be configured to receive an audio signal comprising an audio signal from another device, e.g. from a microphone located separately from the main part of the hearing assistance device in question (but e.g. at or near the same ear). Such received signal INw may (e.g. in a specific mode of operation, e.g. controlled via signal UC from the user interface UI) be one of the input audio signals to the multi-channel noise reduction system (NRS). Each of the left and right hearing instruments ($HAD_l$, $HAD_r$) comprises a control unit (CONT) for controlling the multi-channel noise reduction system (NRS) via signals $cnt_{NRS,l}$ and $cnt_{NRS,r}$. The control signals $cnt_{NRS}$ may e.g. include localization information regarding the currently present audio source(s) as received from the user interface(s) (UI) (cf. respective input signals $loc_{s,l}$, $loc_{s,r}$ to control units CONT). The respective multi-channel noise reduction systems (NRS) of the left and right hearing instruments is e.g. embodied as shown in FIG. 1C. The multi-channel noise reduction systems (NRS provides an enhanced (beamformed and noise reduced) signal $\hat{S}$ ($\hat{S}_l$, $\hat{S}_r$, respectively). The respective signal processing units (SPU) receive the enhanced input signal $\hat{S}$ ($\hat{S}_l$, $\hat{S}_r$, respectively) and provides a further processed output signal $p\hat{S}$ ($p\hat{S}_l$, $p\hat{S}_r$, respectively), which is fed to the output transducer (SPK) for being presented to the user as an audible signal OUT ($OUT_l$, $OUT_r$, respectively). The signal processing unit (SPU) may apply further algorithms to the input signal, e.g. including applying a frequency dependent gain for compensating for a user's particular hearing impairment. In an embodiment, the system is adapted so that a user interface of the auxiliary device (UI in FIG. 4) allows a user (U) to indicate a direction to or a location of a target signal source ($S_s$) relative to the user (U) (via the wireless receiver (ANT, RF-Rx/Tx) and signal INw, providing signal $loc_s$ (dashed arrow) in FIG. 2B between the selection or mixing unit (SEL/MIX) and the control unit (CONT)). The hearing instruments ($HAD_l$, $HAD_r$) further comprises a memory (e.g. embodied in respective control units CNT) for storing a database of comprising a number of predefined look vectors and/or beamformer weights each corresponding to the beamformer pointing in and/or focusing at a number of predefined directions and/or locations. In an embodiment, the user provides information about target direction (phi) of and distance (d=range) to the target signal source (cf. e.g. FIG. 5) via the user interface (UI). In an embodiment, the number of (sets of) predefined beamformer weights stored in the memory unit correspond to a number of (sets of) specific values (φ, d) of target direction (phi, φ) of and distance (range, d). In the binaural hearing assistance system of FIG. 2B, signals $CNT_{s,r}$ and $CNT_{s,l}$, are transmitted via bi-directional wireless link IA-WL from the right to the left and from the left to the right hearing instruments, respectively.

These signals are received and extracted by the respective antenna (ANT) and transceiver circuitries (IA-Rx/Tx) and forwarded to the respective control units (CONT) of the opposite hearing instrument as signals $CNT_{lr}$ and $CNT_{rl}$, in the left and right hearing instruments, respectively. The signals $CNT_{lr}$ and $CNT_{rl}$ comprises information allowing a synchronization of the multi-channel noise reduction systems (NRS) of the left and right hearing instruments (e.g. source localization data, gains of respective single-channel noise reduction systems, sensor signals, e.g. from respective voice activity detectors, etc.). A combination of the respective data from the local and the opposite hearing instrument can be used together to update the respective multi-channel noise reduction systems (NRS) and to thereby maintain localization cues in resulting signal(s) of the forward path in the left and right hearing instruments. The manually operable and/or a remotely operable user interface(s) (UI) (generating a control signals $UC_r$ and $UC_l$, respectively) may e.g. provide user inputs to one or more or the signal processing unit (SPU), the control unit (CONT), the selector and mixer unit (T->TF-SEL-MIX) and the multi-channel noise reduction system (NRS).

FIG. 3 shows examples of a mutual location in space of elements of a binaural hearing assistance system and/or a sound source relative to a user, represented in a spherical and an orthogonal coordinate system. FIG. 3A defines coordinates of a spherical coordinate system (d, θ, ω) in an orthogonal coordinate system (x, y, z). A given point in three dimensional space (here illustrated by a location of sound source $S_s$) whose location is represented by a vector $d_s$ from the center of the coordinate system (0, 0, 0) to the location ($x_s$, $y_s$, $z_s$) of the sound source $S_s$ in the orthogonal coordinate system is represented by spherical coordinates ($d_s$, $\theta_s$, $\varphi_s$), where $d_s$ is the radial distance to the sound source $S_s$, $\theta_s$ is the (polar) angle from the z-axis of the orthogonal coordinate system (x, y, z) to the vector $d_s$, and $\varphi_s$, is the (azimuth) angle from the x-axis to a projection of the vector $d_s$ in the xy-plane of the orthogonal coordinate system.

Figure 3A:
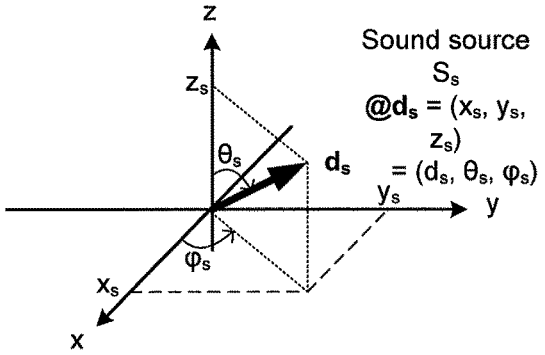
Figure 3B:
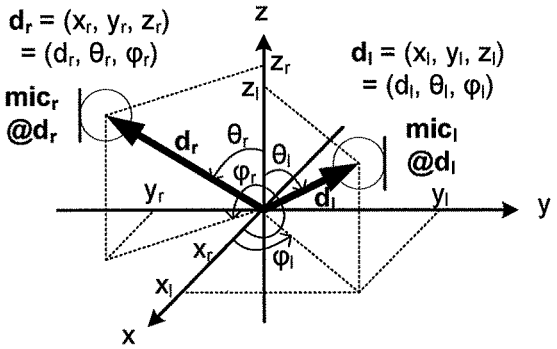
Figure 3C:
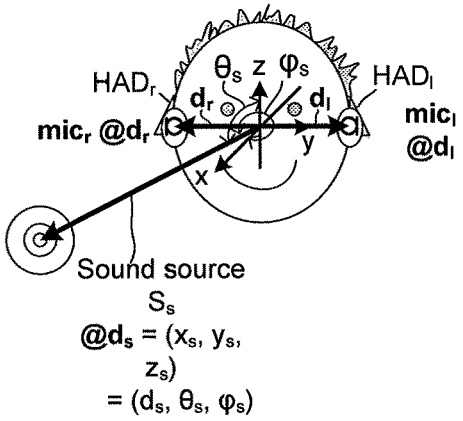
Figure 3D:
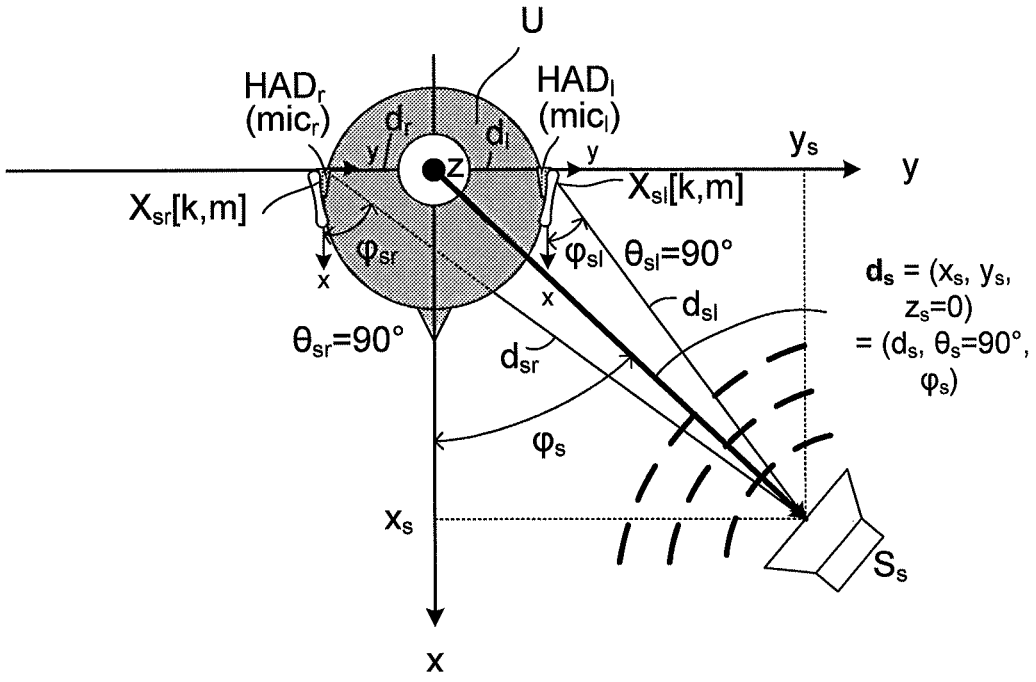

FIG. 3B defines the location of left and right hearing assistance devices $HAD_l$, $HAD_r$ (see FIG. 3C, 3D, here in FIG. 3B represented by left and right microphones $mic_l$, $mic_r$) in orthogonal and spherical coordinates, respectively. The center (0, 0, 0) of the coordinate systems can in principle be located anywhere, but is here (to utilize the symmetry of the setup) assumed to be located midway between the location of the centers of the left and right microphones $mic_l$, $mic_r$, as illustrated in FIG. 3C, 3D. The location of the left and right microphones $mic_l$, $mic_r$ are defined by respective vectors $d_l$ and $d_r$, which can be represented by respective sets of rectangular and spherical coordinates ($x_l$, $y_l$, $z_l$), ($d_l$, $\theta_l$, $\varphi_l$) and ($x_r$, $y_r$, $z_r$), ($d_r$, $\theta_r$, $\varphi_r$).

FIG. 3C defines the location of left and right hearing assistance devices $HAD_l$, $HAD_r$ (here represented by left and right microphones $mic_l$, $mic_r$) relative to a sound source $S_s$ in orthogonal and spherical coordinates, respectively. The center (0, 0, 0) of the coordinate systems is assumed to be located midway between the location of the centers of the left and right microphones $mic_l$, $mic_r$. The location of the left and right microphones $mic_l$, $mic_r$ are defined by vectors $d_l$ and $d_r$, respectively. The location of the sound source $S_s$ is defined by vector $d_s$ and orthogonal and spherical coordinates ($x_s$, $y_s$, $z_s$) and ($d_s$, $\theta_s$, $\varphi_s$), respectively. The sound source $S_s$ may e.g. illustrate a person speaking (or otherwise expressing him or herself), a loudspeaker playing sound (or a wireless transmitter transmitting an audio signal to a wireless receiver of one or both of the hearing assistance devices).

FIG. 3D defines a similar setup as shown in FIG. 30. FIG. 3D illustrates a user U equipped with left and right hearing assistance devices $HAD_l$, $HAD_r$ and a sound source $S_s$ (e.g. a loudspeaker, as shown, or a person speaking) located in front, to the left of the user. Left and right microphones $mic_l$, $mic_r$ of the left and right hearing assistance devices $HAD_l$, $HAD_r$ receive time variant sound signals from sound source $S_s$. The sound signals are received by the respective microphones and converted to electric input signals and provided in a time frequency representation in the form of (complex) digital signals $X_{sl}[m,k]$ and $X_{sr}[m,k]$ in the left and right hearing assistance devices $HAD_l$, $HAD_r$, m being a time index and k being a frequency index (i.e. here the time to time-frequency conversion units (analysis filter banks AFB in FIG. 1B, or T->TF in FIG. 2B) are included in the respective input units (e.g. microphone units)). The directions of propagation of the sound wave-fronts from the sound source $S_s$ to the respective left and right microphone units $mic_l$, $mic_r$ are indicated by lines (vectors) $d_{sl}$ and $d_{sr}$, respectively. The center (0, 0, 0) of the orthogonal coordinate system (x, y, z) is located midway between the left and right hearing assistance devices $HAD_l$, $HAD_r$, which are assumed to lie in the xy-plane (z=0, θ=90° together with the sound source $S_s$. The different distances, $d_{sl}$ and $d_{sr}$, from the sound source $S_s$ to the left and right hearing assistance devices $HAD_l$, $HAD_r$, respectively, account for different times of arrival of a given sound wave-front at the two microphones $mic_l$, $mic_r$, hence resulting in an ITD($d_s$, $\theta_s$, $\varphi_s$) (ITD=Inter-aural Time Difference). Likewise the different constitution of the propagation paths from the sound source to the left and right hearing assistance devices gives rise to different levels of the received signals at the two microphones $mic_l$, $mic_r$ (the path to the right hearing assistance device $HAD_r$ is influenced by the users' head (as indicated by the dotted line segment of the vector $d_{sr}$, the path to the left hearing assistance device $HAD_l$ is NOT). In other words an ILD($d_s$, $\theta_s$, $\varphi_s$) is observed (ILD=Inter-aural Level Difference). These differences (that are perceived by a normally hearing person as localization cues) are to a certain extent (depending on the actual location of the microphones on the hearing assistance device) reflected in the signals $X_{sl}[m,k]$ and $X_{sr}[m,k]$ and can be used to extract the head related transfer functions (or to maintain the influence thereof in received signals) for the given geometrical scenario for a point source located at ($d_s$, $\theta_s$, $\varphi_s$).

Figure 4A:
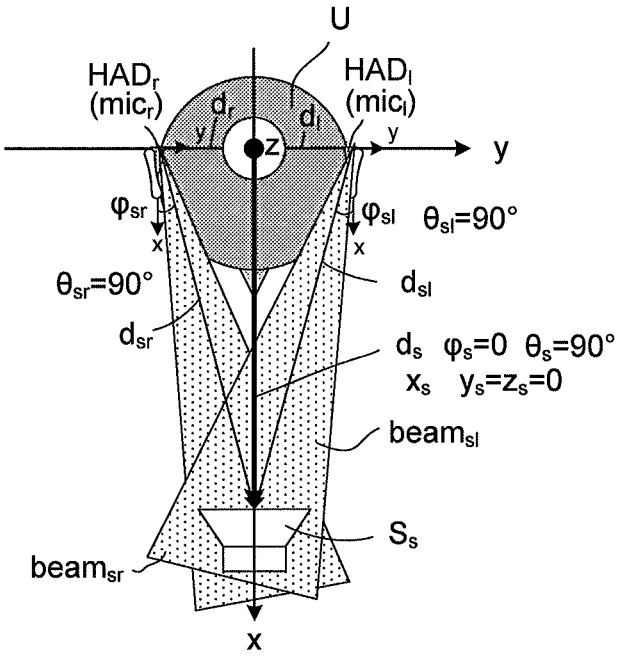
Figure 4B:
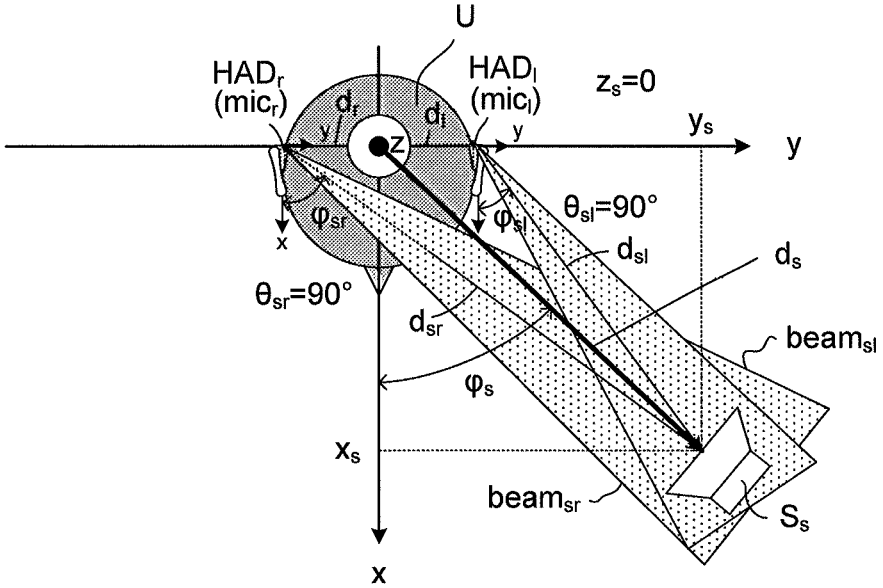

FIG. 4 shows two examples of locations of a target sound source relative to a user. FIG. 4A shows a typical (default) example where the target sound source $S_s$ is located in front of the user (U) at a distance $|d_s|$ ($\varphi_s$=0°; it is further assumed that θ=90°, i.e. that the sound source $S_s$ is located in the same plane as the microphones of the left and right hearing assistance devices; this need not to be the case, however). The beams ($beam_{sl}$ and $beam_{sr}$) of the respective multi-channel beamformer filtering units of the multi-input unit noise reduction systems of the left and right hearing assistance devices are synchronized to focus on the target sound source $S_s$. FIG. 4B shows an example where the target sound source $S_s$ is located in the quadrant (x>0, y>0) to the left of the user (U) ($\varphi_s$~45°). The user is assumed to have indicated this position of the sound source via the user interface, resulting again in the beams ($beam_{sl}$ and $beam_{sr}$) of the respective multi-channel beamformer filtering units being synchronized to focus on the target sound source $S_s$ (e.g. based on predetermined filtering weights for the respective beamformers for the chosen location of the sound source; the location being e.g. chosen among a number of predefined locations).

Figure 5:
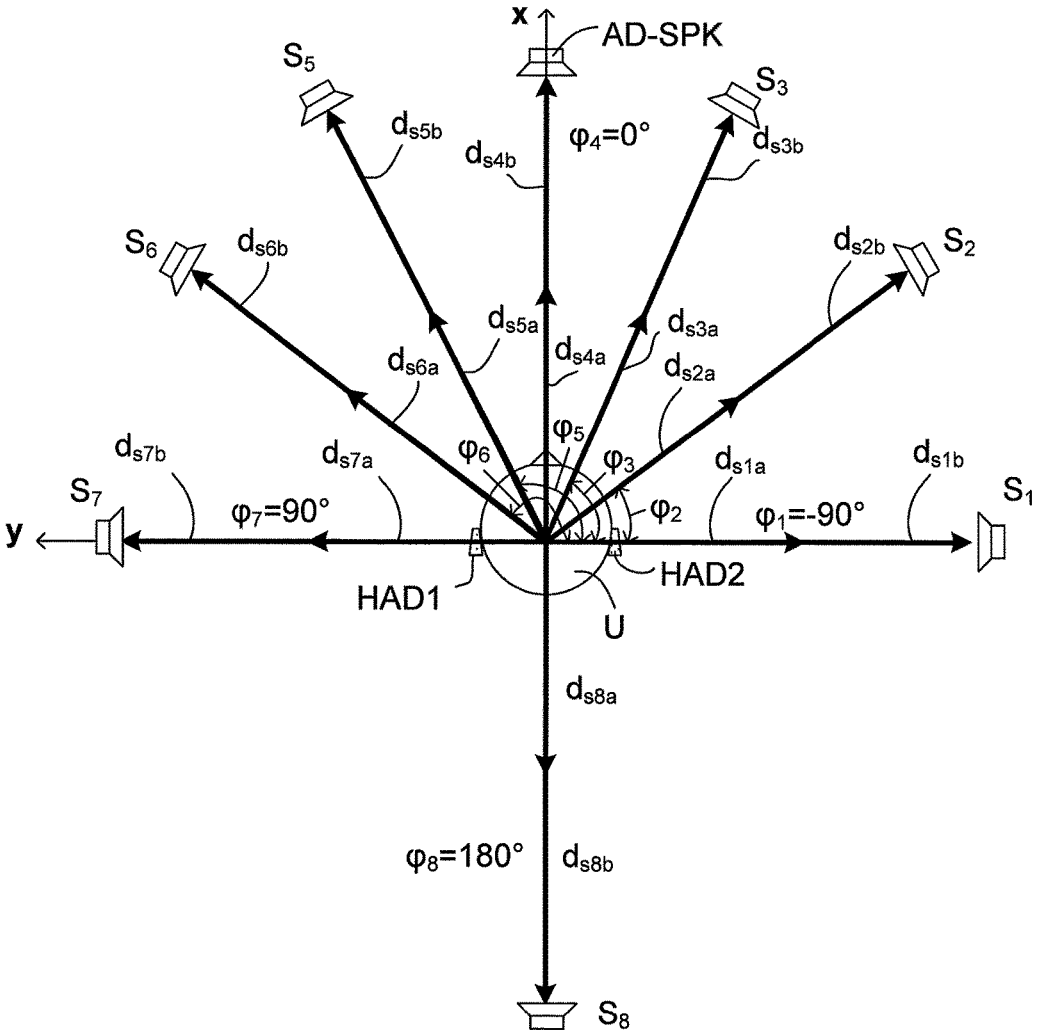

FIG. 5 shows a number of predefined orientations of the look vector relative to a user. FIG. 5 illustrates predefined directions from a user (U) to a target source $S_q$ defined by vectors $d_{sq}$, q=1, 2, . . . , $N_s$ or angle $\varphi_q$ and distance $d_q=|d_{sq}|$. In FIG. 5, it is assumed that the sound source $S_s$ is located in the same plane as the microphones of the left and right hearing assistance devices ($HAD_l$ and $HAD_r$). In an embodiment, predefined look vectors and/or filter weights for the respective multi-channel beamformer filtering units of the multi-input unit noise reduction systems of the left and right hearing assistance devices are stored in a memory of the left and right hearing assistance devices. Predefined angles $\varphi_q$, q=1, 2, . . . , 8 distributed in the front half plane (with respect to the user's face) corresponding to x≥0 and in the rear half plane corresponding to x<0 are exemplified in FIG. 5. The density of predefined angles is larger in the front half plane than in the rear half plane. In the example of FIG. 5, $\varphi_1$-$\varphi_7$ are located in the front half plane (e.g. evenly with 30° between them from $\varphi_1$=−90° to $\varphi_7$=+90°, whereas $\varphi_8$ is located in the rear half plane ($\varphi_8$=180°). For each predefined angle $\omega_q$, a number of distances $d_q$ may be defined, in FIG. 5 two different distances, denoted a and b ($d_{sqb}$~2*$d_{sqa}$), are indicated. Any number of predefined angles and distances may be defined in advance and corresponding look vectors and/or filter weights determined and stored in a memory of the respective left and right hearing assistance devices (or be accessible from a common database of the binaural hearing assistance system, e.g. located in an auxiliary device, e.g. a SmartPhone). In an embodiment, the user interface is implemented as an APP of a SmartPhone. By storing a number of predefined look vectors (or beamformer weights) and letting the user select one of them (by indicating a direction or location of the target source via the user interface), the user effectively provides the look vector (beamformer weights) of relevance to the current acoustic environment of the user. The predefined look vectors (or beamformer weights) may e.g. be determined by measurement for different directions and distances on a model user, e.g. a Head and Torso Simulator (HATS) 4128C from Brûel & Kjær Sound & Vibration Measurement A/S 'equipped' with first and second hearing assistance devices.

Figure 6A:
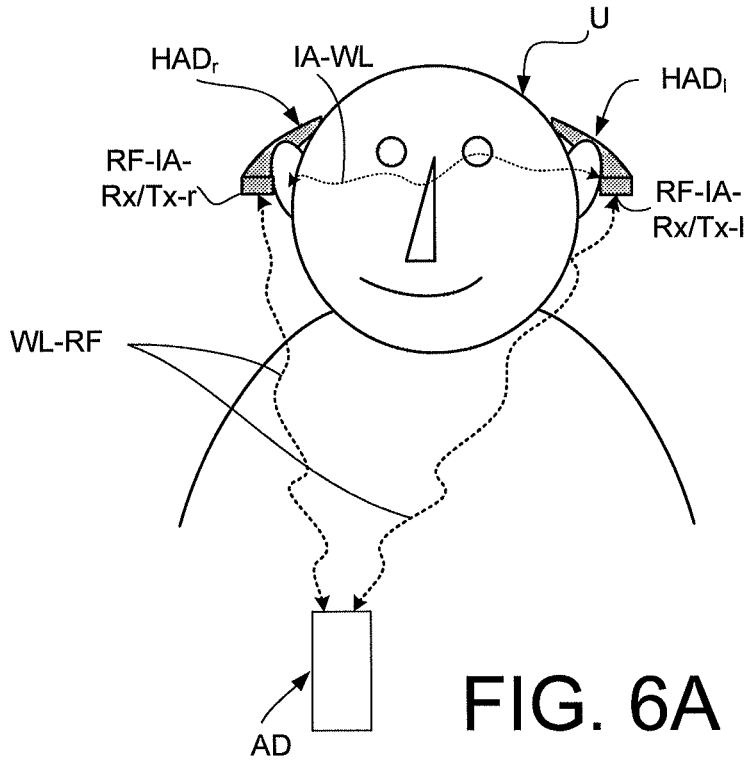
FIGS. 6A-6B show an embodiment of a binaural hearing aid system comprising left and right hearing assistance devices in communication with an auxiliary device (FIG. 6A), the auxiliary device functioning as a user interface (FIG. 6B) for the binaural hearing aid system.
Figure 6B:
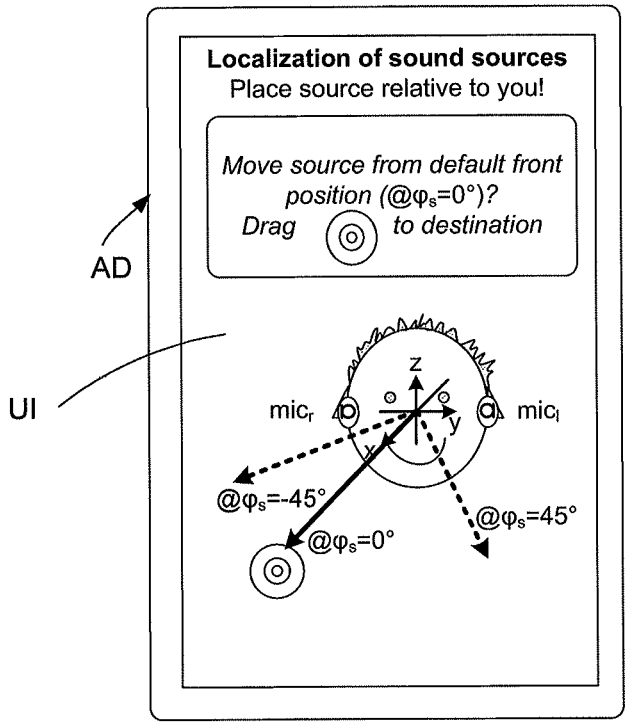

FIG. 6A shows an embodiment of a binaural hearing aid system comprising left (second) and right (first) hearing assistance devices ($HAD_l$, $HAD_r$) in communication with a portable (handheld) auxiliary device (AD) functioning as a user interface (UI) for the binaural hearing aid system. In an embodiment, the binaural hearing aid system comprises the auxiliary device AD (and the user interface UI). The user interface UI of the auxiliary device AD is shown in FIG. 6B. The user interface comprises a display (e.g. a touch sensitive display) displaying a user of the hearing assistance system and a number of predefined locations of target sound sources relative to the user. The user U is encouraged to choose a location for a current target sound source by dragging a sound source symbol to the approximate location of the target sound source (if deviating from a front direction and a default distance). The 'Localization of sound sources' is implemented as an APP of the auxiliary device (e.g. a SmartPhone). In an embodiment, the chosen location is communicated to the left and right hearing assistance devices for use in choosing an appropriate corresponding predetermined set of filter weights, or for calculating such weights based on the received location of the sound source. Alternatively, the appropriate filter weights determined or stored in the auxiliary device may be communicated to the left and right hearing assistance devices for use in the respective beamformer filtering units. The auxiliary device AD comprising the user interface UI is adapted for being held in a hand of a user (U), and hence convenient for displaying a current location of a target sound source.

In an embodiment, communication between the hearing assistance device and the auxiliary device is in the base band (audio frequency range, e.g. between 0 and 20 kHz). Preferably however, communication between the hearing assistance device and the auxiliary device is based on some sort of modulation at frequencies above 100 kHz. Preferably, frequencies used to establish a communication link between the hearing assistance device and the auxiliary device is below 70 GHz, e.g. located in a range from 50 MHz to 70 GHz, e.g. above 300 MHz, e.g. in an ISM range above 300 MHz, e.g. in the 900 MHz range or in the 2.4 GHz range or in the 5.8 GHz range or in the 60 GHz range (ISM=Industrial, Scientific and Medical, such standardized ranges being e.g. defined by the International Telecommunication Union, ITU). In an embodiment, the wireless link is based on a standardized or proprietary technology. In an embodiment, the wireless link is based on Bluetooth technology (e.g. Bluetooth Low-Energy technology) or a related technology.

In the embodiment of FIG. 6A, wireless links denoted IA-WL (e.g. an inductive link between the hearing left and right assistance devices) and WL-RF (e.g. RF-links (e.g. Bluetooth) between the auxiliary device AD and the left $HAD_l$, and between the auxiliary device AD and the right $HAD_r$, hearing assistance device, respectively) are indicated (implemented in the devices by corresponding antenna and transceiver circuitry, indicated in FIG. 6*a* in the left and right hearing assistance devices as RF-IA-RX/TX-I and RF-IA-Rx/Tx-r, respectively).

In an embodiment, the auxiliary device AD is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing assistance device. In an embodiment, the auxiliary device is or comprises a remote control for controlling functionality and operation of the hearing assistance device(s). In an embodiment, the function of a remote control is implemented in a SmartPhone, the SmartPhone possibly running an APP allowing to control the functionality of the audio processing device via the SmartPhone (the hearing assistance device(s) comprising an appropriate wireless interface to the SmartPhone, e.g. based on Bluetooth or some other standardized or proprietary scheme).

In the present context, a SmartPhone, may comprise

- a (A) cellular telephone comprising a microphone, a speaker, and a (wireless) interface to the public switched telephone network (PSTN) COMBINED with
- a (B) personal computer comprising a processor, a memory, an operative system (OS), a user interface (e.g. a keyboard and display, e.g. integrated in a touch sensitive display) and a wireless data interface (including a Web-browser), allowing a user to download and execute application programs (APPs) implementing specific functional features (e.g. displaying information retrieved from the Internet, remotely controlling another device, combining information from various sensors of the smartphone (e.g. camera, scanner, GPS, microphone, etc.) and/or external sensors to provide special features, etc.).

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims and equivalents thereof.

REFERENCES

EP2701145A1 (OTICON)

The invention claimed is:

1. A binaural hearing assistance system comprising left and right hearing assistance devices adapted for being located at or in left and right ears of a user, or adapted for being fully or partially implanted in the head of the user, each of the left and right hearing assistance devices comprising a) a multitude of input units $IU_i$, i=1, . . . , M, M being larger than or equal to two, for providing a time-frequency representation $X_i(k,m)$ of an input signal $x_i(n)$ at an $i^{th}$ input unit in a number of frequency bands and a number of time instances, k being a frequency band index, m being a time index, n representing time, the time-frequency representation $X_i(k,m)$ of the $i^{th}$ input signal comprising a target signal component and a noise signal component, the target signal component originating from a target signal source; and b) a multi-input unit noise reduction system comprising a multi-channel beamformer filtering unit operationally coupled to said multitude of input units $IU_i$, i=1, . . . , M, and configured to provide a beamformed signal Y(k,m), wherein signal components from other directions than a direction of the target signal source are attenuated, whereas signal components from the direction of the target signal source are left un-attenuated or attenuated less than signal components from said other directions;

wherein the binaural hearing assistance system further comprises a user interface configured to communicate with said left and right hearing assistance devices and to allow a user to influence functionality of the left and right hearing assistance devices, and is configured to allow a user to indicate a direction to or a location of the target signal source relative to the user via said user interface, and is adapted to synchronize the respective multi-channel beamformer filtering units of the left and right hearing assistance devices so that both beamformer filtering units focus on the direction or location of the target signal source.

2. A binaural hearing assistance system according to claim 1 wherein multi-channel beamformer filtering units of the left and right hearing assistance devices are designed to deliver a gain of 0 dB for signals originating from a given direction or location, while suppressing signal components originating from any other spatial location.

3. A binaural hearing assistance system according to claim 1 wherein the multi-channel beamformer filtering units of the left and right hearing assistance devices are designed to deliver a larger gain (smaller attenuation) for signals originating from a given target direction or location, than signal components originating from any other spatial location.

4. A binaural hearing assistance system according to claim 1 wherein the multi-channel beamformer filtering units of the left and right hearing assistance devices are configured to apply the same gain or attenuation to signal components from the target signal source, so that any spatial cues in the target signal are not obscured by the beamformers.

5. A binaural hearing assistance system according to claim 1 wherein the multi-channel beamformer filtering unit of each of the left and right hearing assistance devices comprises a linearly constrained minimum variance (LCMV) beamformer, or a minimum variance distortionless response (MVDR) beamformer.

6. A binaural hearing assistance system according to claim 1 wherein the multi-channel beamformer filtering unit of each of the left and right hearing assistance devices comprises a minimum variance distortionless response (MVDR) filter providing filter weights $w_{mvdr}(k,m)$, said filter weights $w_{mvdr}(k,m)$ being based on a look vector d(k,m) and an inter-input unit covariance matrix $R_{vv}(k,m)$ for the noise signal.

7. A binaural hearing assistance system according to claim 1 wherein each of the left and right hearing assistance devices comprises a memory unit comprising a number of predefined look vectors, each corresponding to the beamformer pointing in and/or focusing at a predefined direction and/or location.

8. A binaural hearing assistance system according to claim 1 configured to provide said target direction or location for said left and right hearing assistance devices from a given target direction or location for the target sound source.

9. A binaural hearing assistance system according to claim 1 wherein each of the left and right hearing assistance devices comprises a voice activity detector for identifying respective time segments of an input signal where a human voice is present or dominant.

10. A binaural hearing assistance system according to claim 1 wherein the user interface forms part of an auxiliary device.

11. A binaural hearing assistance system according to claim 10 wherein the user interface is configured to communicate the indicated direction or location of the target sound source to the left and right hearing assistance devices for use in choosing an appropriate corresponding predetermined set of filter weights for the multi-channel beamformer filtering unit, or for calculating such weights based on the received location of the target sound source.

12. A binaural hearing assistance system according to claim 10 wherein appropriate filter weights determined or stored in the auxiliary device are communicated to the left and right hearing assistance devices for use in the respective beamformer filtering units.

13. A binaural hearing assistance system according to claim 10, wherein the user interface is implemented as a software application executed on the auxiliary device.

14. A binaural hearing assistance system according to claim 10, wherein the user interface is configured to allow a user to select a current location of the target sound source from a number of predefined vectors $d_{sq}$, q=1, 2, . . . , $N_s$, or angles $\varphi_q$, or angles $\varphi_q$ and distances $d_q=|d_{sq}|$, q=1, 2, . . . , $N_s$.

15. A binaural hearing assistance system according to claim 14 configured to provide that for each of the predefined angles and distances q=1, 2, . . . , $N_s$ corresponding look vectors and/or filter weights are determined and stored in a memory of the respective left and right hearing assistance devices or are accessible from a common database of the binaural hearing assistance system.

16. A binaural hearing assistance system according to claim 14 configured to provide that for each of the predefined angles and distances $q=1, 2, \ldots, N_s$ corresponding look vectors and/or filter weights are accessible from a common database of the binaural hearing assistance system, wherein the common database is located in the auxiliary device.

17. A binaural hearing assistance system according to claim 10 adapted to allow an external wireless communication link between the auxiliary device and the respective left and right hearing assistance devices to be established to allow exchange of data between the left and right hearing aid devices.

18. A binaural hearing assistance system according to claim 1 wherein at least one of said multitude of input units $IU_i$ of the left and right hearing assistance devices comprises a microphone for converting an input sound to an electric input signal $x'_i(n)$ and a time to time-frequency conversion unit for providing a time-frequency representation $X_i(k,m)$ of the input signal $x_i(n)$ at the $i^{th}$ input unit $IU_i$ in a number of frequency bands k and a number of time instances m.

19. A binaural hearing assistance system according to claim 1 wherein the time dependent input signals $x_{il}(n)$ and $x_{ir}(n)$, $i=1, \ldots, M$, are signals originating from acoustic signals received at the respective left and right ears of the user to include spatial cues related to the head and body of the user.

20. A binaural hearing assistance system according to claim 1 wherein each of said left and right hearing assistance devices further comprises a single channel post-processing filter unit operationally coupled to said multi-channel beamformer filtering unit and configured to provide an enhanced signal $\hat{S}(k,m)$.

21. A binaural hearing assistance system according to claim 20 wherein the multi-channel beamformer filtering unit and/or the single channel post-processing filter unit is/are configured to maintain interaural spatial cues of the target signal.

22. A binaural hearing assistance system according to claim 1 adapted to allow an interaural wireless communication link between the left and right hearing assistance devices to be established to allow exchange of data between the left and right hearing aid devices.

23. A binaural hearing assistance system according to claim 1 wherein the left and right hearing assistance devices each comprise a hearing instrument adapted for being located at the ear or fully or partially in the ear canal of a user, or for being fully or partially implanted in the head of a user.

24. A method of operating a binaural hearing assistance system, the system comprising left and right hearing assistance devices adapted for being located at or in left and right ears of a user, or adapted for being fully or partially implanted in the head of the user, the binaural hearing assistance system further comprising a user interface configured to communicate with said left and right hearing assistance devices and to allow a user to influence functionality of the left and right hearing assistance devices, the method comprising in each of the left and right hearing assistance devices a) providing a time-frequency representation $X_i(k,m)$ of an input signal $x_i(n)$ at an $i^{th}$ input unit in a number of frequency bands and a number of time instances, k being a frequency band index, m being a time index, n representing time, M being larger than or equal to two, for the time-frequency representation $X_i(k,m)$ of the $i^{th}$ input signal comprising a target signal component and a noise signal component, the target signal component originating from a target signal source;

b) providing a beamformed signal Y(k,m) from said time-frequency representations $X_i(k,m)$ of said multitude of input signals, wherein signal components from other directions than a direction of the target signal source are attenuated, whereas signal components from the direction of the target signal source are left unattenuated or are attenuated less than signal components from said other directions in said beamformed signal Y(k,m); and configuring the binaural hearing assistance system to allow a user to indicate a direction to or a location of the target signal source relative to the user via said user interface, and synchronizing the respective multi-channel beamformer filtering units of the left and right hearing assistance devices so that both beamformer filtering units focus on the location of the target signal source.

25. A data processing system comprising a processor and program code means for causing the processor to perform the steps of the method of claim 24.

* * * * *